US011413480B2

(12) United States Patent
Isham et al.

(10) Patent No.: US 11,413,480 B2
(45) **Date of Patent: *Aug. 16, 2022**

(54) PERSONAL PROTECTION SYSTEM WITH CONTROL MEMBER

(71) Applicant: Stryker Corporation, Kalamazoo, MI (US)

(72) Inventors: Stephen Isham, Mattawan, MI (US); Stephen Reasoner, Kalamazoo, MI (US); Benjamin Edinger, Grand Haven, MI (US)

(73) Assignee: Stryker Corporation, Kalamazoo, MI (US)

( * ) Notice: Subject to any disclaimer, the term of this patent is extended or adjusted under 35 U.S.C. 154(b) by 404 days.

This patent is subject to a terminal disclaimer.

(21) Appl. No.: 16/523,224

(22) Filed: Jul. 26, 2019

(65) Prior Publication Data

US 2019/0344101 A1 Nov. 14, 2019

Related U.S. Application Data

(63) Continuation of application No. 15/787,162, filed on Oct. 18, 2017, now Pat. No. 10,384,084.

(51) Int. Cl.
*A62B 18/04* (2006.01)
*A62B 18/08* (2006.01)
(Continued)

(52) U.S. Cl.
CPC ..... *A62B 18/045* (2013.01); *A41D 1/002* (2013.01); *A41D 13/1153* (2013.01);
(Continued)

(58) Field of Classification Search
CPC A41D 13/1153; A41D 13/1184; A41D 13/12; A41D 13/18; A41D 13/1209;
(Continued)

(56) References Cited

U.S. PATENT DOCUMENTS 6,481,019 B2 11/2002 Diaz et al.
6,622,311 B2 9/2003 Diaz et al.
(Continued)

FOREIGN PATENT DOCUMENTS

AU 2013200577 B2 10/2014
CA 2805821 A1 8/2013
(Continued)

OTHER PUBLICATIONS

International Search Report for Application No. PCT/US2018/056421 dated Feb. 5, 2019, 4 pages.
(Continued)

*Primary Examiner* — Kathryn E Ditmer
(74) *Attorney, Agent, or Firm* — Howard & Howard Attorneys PLLC

(57) ABSTRACT

A personal protection system including a garment configured for attachment to a helmet, wherein the garment defines a barrier between a wearer and an environment. The system includes a control mount integral to the garment and at least partially disposed on the environment side and the wearer side of the barrier. The system may include an emitter and a sensor configured to detect a signal output by the emitter. The control mount may comprise a lens configured to transmit the signal from the emitter through the garment. A control member may be coupled to the control mount and configured to be manipulated by the wearer. When manipulated by the wearer, the control member may distort and/or disrupt the transfer of the signal through the lens that is detected by the sensor. The sensor may provide a sensor input signal based on the signal detected from the emitter.

17 Claims, 23 Drawing Sheets

(51) Int. Cl.

| | |
|---|---|
| ***A41D 13/12*** | (2006.01) |
| ***A41D 13/11*** | (2006.01) |
| ***F21L 4/00*** | (2006.01) |
| ***A41D 1/00*** | (2018.01) |
| ***F21V 5/04*** | (2006.01) |
| ***F21V 23/00*** | (2015.01) |
| ***A42B 3/28*** | (2006.01) |

(52) U.S. Cl.
CPC ..... *A41D 13/1184* (2013.01); *A41D 13/1218* (2013.01); *A42B 3/286* (2013.01); *A62B 18/082* (2013.01); *F21L 4/00* (2013.01); *F21V 5/04* (2013.01); *F21V 23/003* (2013.01)

(58) Field of Classification Search
CPC ..... A41D 1/002; A62B 18/045; A62B 18/08; A62B 18/082; A42B 3/286
See application file for complete search history.

(56) References Cited

U.S. PATENT DOCUMENTS

| | | | | |
|---|---|---|---|---|
| 6,629,944 | B2 | 10/2003 | Smart | |
| 6,755,195 | B1 | 6/2004 | Lemke et al. | |
| 6,973,677 | B2 | 12/2005 | Diaz et al. | |
| 6,990,691 | B2 | 1/2006 | Klotz et al. | |
| 7,093,302 | B1 * | 8/2006 | Burns | A61F 9/06 2/8.1 |
| 7,735,156 | B2 | 6/2010 | VanDerWoude et al. | |
| 7,752,682 | B2 | 7/2010 | VanDerWoude et al. | |
| 7,926,118 | B2 | 4/2011 | Becker et al. | |
| 7,931,648 | B2 | 4/2011 | Schneider | |
| 7,947,050 | B2 | 5/2011 | Lee et al. | |
| 7,951,145 | B2 | 5/2011 | Schneider | |
| 8,020,552 | B2 * | 9/2011 | Dillon | A42B 3/286 128/201.24 |
| 8,182,479 | B2 | 5/2012 | Schneider | |
| 8,209,438 | B2 | 6/2012 | Bauch et al. | |
| 8,234,722 | B2 | 8/2012 | VanDerWoude et al. | |
| 8,407,818 | B2 | 4/2013 | VanDerWoude et al. | |
| 8,449,541 | B2 | 5/2013 | Schneider | |
| 8,602,031 | B2 | 12/2013 | Reis et al. | |
| 8,653,702 | B2 | 2/2014 | Saleh | |
| 8,819,869 | B2 | 9/2014 | VanDerWoude et al. | |
| 8,950,017 | B2 | 2/2015 | Czajka et al. | |
| 9,027,710 | B2 | 5/2015 | Machovic Basic et al. | |
| 9,149,337 | B2 | 10/2015 | Schneider | |
| 9,173,437 | B2 | 11/2015 | VanDerWoude et al. | |
| 9,241,764 | B2 | 1/2016 | Schneider | |
| 9,439,462 | B2 | 9/2016 | Czajka et al. | |
| 9,445,876 | B2 | 9/2016 | Ingmanson et al. | |
| 9,480,290 | B2 | 11/2016 | Czajka et al. | |
| 10,092,129 | B2 | 10/2018 | Jenkins et al. | |
| 10,384,084 | B2 * | 8/2019 | Isham | F21L 4/00 |
| 2004/0167455 | A1 | 8/2004 | Smart | |
| 2007/0050898 | A1 | 3/2007 | Larson et al. | |
| 2008/0202509 | A1 | 8/2008 | Dillon et al. | |
| 2009/0151054 | A1 * | 6/2009 | VanDerWoude | A41D 13/1153 2/410 |
| 2010/0245388 | A1 | 9/2010 | Bauch et al. | |
| 2011/0004979 | A1 | 1/2011 | VanDerWoude et al. | |
| 2011/0049117 | A1 * | 3/2011 | Macher | A61F 7/007 219/211 |
| 2011/0088702 | A1 | 4/2011 | King et al. | |
| 2013/0087544 | A1 * | 4/2013 | Kremer | H05B 3/00 219/211 |
| 2015/0090254 | A1 | 4/2015 | Pavalarajan et al. | |
| 2015/0213215 | A1 | 7/2015 | Kobayashi et al. | |
| 2015/0375019 | A1 | 12/2015 | VanDerWoude et al. | |
| 2016/0015476 | A1 | 1/2016 | Jagga | |
| 2016/0095664 | A1 | 4/2016 | Schneider | |
| 2016/0174636 | A1 | 6/2016 | Schneider | |
| 2016/0339276 | A1 | 11/2016 | Czajka et al. | |
| 2016/0346147 | A1 | 12/2016 | Brown | |
| 2016/0354068 | A1 | 12/2016 | Schneider et al. | |
| 2017/0020210 | A1 | 1/2017 | Czajka et al. | |
| 2017/0042627 | A1 | 2/2017 | Schneider | |
| 2017/0196281 | A1 | 7/2017 | Rosati et al. | |
| 2017/0215983 | A1 | 8/2017 | Learn | |
| 2017/0239010 | A1 | 8/2017 | Franjic et al. | |

FOREIGN PATENT DOCUMENTS

| | | | | |
|---|---|---|---|---|
| CN | 103402383 | A | 11/2013 | |
| CN | 204240072 | U | 4/2015 | |
| CN | 205433271 | U | 8/2016 | |
| DE | 19954497 | C1 | 4/2001 | |
| DE | 202007002332 | U1 | 5/2007 | |
| DE | 102007007742 | B4 | 4/2009 | |
| DE | 102016121824 | A1 * | 5/2018 | A62B 18/08 |
| EP | 1821483 | A1 | 8/2007 | |
| WO | 2007011646 | A2 | 1/2007 | |
| WO | 2007084198 | A1 | 7/2007 | |
| WO | 2010024933 | A2 | 3/2010 | |
| WO | 2012129396 | A1 | 9/2012 | |
| WO | 2014057817 | A1 | 4/2014 | |
| WO | 2014160149 | A2 | 10/2014 | |
| WO | 2016008041 | A1 | 1/2016 | |
| WO | 2016022777 | A1 | 2/2016 | |
| WO | 2016186578 | A1 | 11/2016 | |
| WO | 2017120562 | A2 | 7/2017 | |
| WO | 2017184479 | A2 | 10/2017 | |

OTHER PUBLICATIONS

English language abstract for CN 103402383 A extracted from espacenet.com database on Mar. 9, 2022, 2 pages.
English language abstract for CN 205433271 U extracted from espacenet.com database on Mar. 9, 2022, 2 pages.
English language abstract and machine-assisted English translation for CN 204240072 U extracted from espacenet.com database on Mar. 9, 2022, 5 pages.

* cited by examiner

PERSONAL PROTECTION SYSTEM WITH CONTROL MEMBER

RELATED APPLICATIONS

This application is a continuation of and claims priority to and the benefit of U.S. application Ser. No. 15/787,162, filed on Oct. 18, 2017, which is hereby incorporated herein by reference in its entirety.

SUMMARY

The present disclosure relates generally to a protective apparel system. The protective apparel system comprises a surgical garment assembly that may be configured for attachment to a surgical helmet, wherein the surgical garment assembly can be employed to provide a microbial barrier between an individual wearing the system and the surrounding environment.

One embodiment provides a protective apparel system comprising a surgical garment configured for attachment to the surgical helmet, wherein the surgical garment includes a control mount integral with the surgical garment, such that the control mount forms at least a portion of a barrier between the wearer and the environment. The control mount may be configured to couple to the surgical helmet on the wearer side of the barrier. A control member is coupled to the control mount on the environment side of the barrier.

These and other embodiments, features, and advantages of the present disclosure will be apparent to those skilled in the art. The present disclosure is not to be limited to or by these embodiments, features, and advantages.

BRIEF DESCRIPTION OF THE DRAWINGS

Referring now to the drawings, exemplary illustrations are shown in detail. Although the drawings represent schematic embodiments, the drawings are not necessarily to scale and certain features may be exaggerated to better illustrate and explain an innovative aspect of an illustrative embodiment. Further, the exemplary illustrations described herein are not intended to be exhaustive or otherwise limiting or restricting to the precise form and configuration shown in the drawings and disclosed in the following detailed description.

Advantages of the present disclosure will be readily appreciated as the same becomes better understood by reference to the following detailed description when considered in connection with the accompanying drawings.

DETAILED DESCRIPTION

Maintaining a reliable barrier between the healthcare provider and the patient to prevent the exchange and/or transfer of particles or foreign material during a medical procedure or examination is of the utmost importance. During medical and surgical procedures, a healthcare provider may wear an assembly known as a protective apparel system, such as the protective apparel system 10 illustrated in FIG. 1.

Accordingly, the protective apparel system 10 may comprise a surgical garment assembly comprising a surgical garment 12 configured for attachment to a surgical helmet 20. The surgical garment 12 is configured to provide a barrier, such as a microbial barrier, between the wearer and the surrounding environment. The barrier created by the surgical garment 12 may benefit both the wearer and the patient. The barrier provided by the surgical garment 12 may substantially eliminate the likelihood that the wearer may come into contact with the fluid or solid particles of matter from the patient that may be generated during the course of a surgical procedure. The barrier may substantially prevent the transfer of any foreign particles emitted by the wearer from being transferred to the patient during the surgical procedure.

Figure 1:
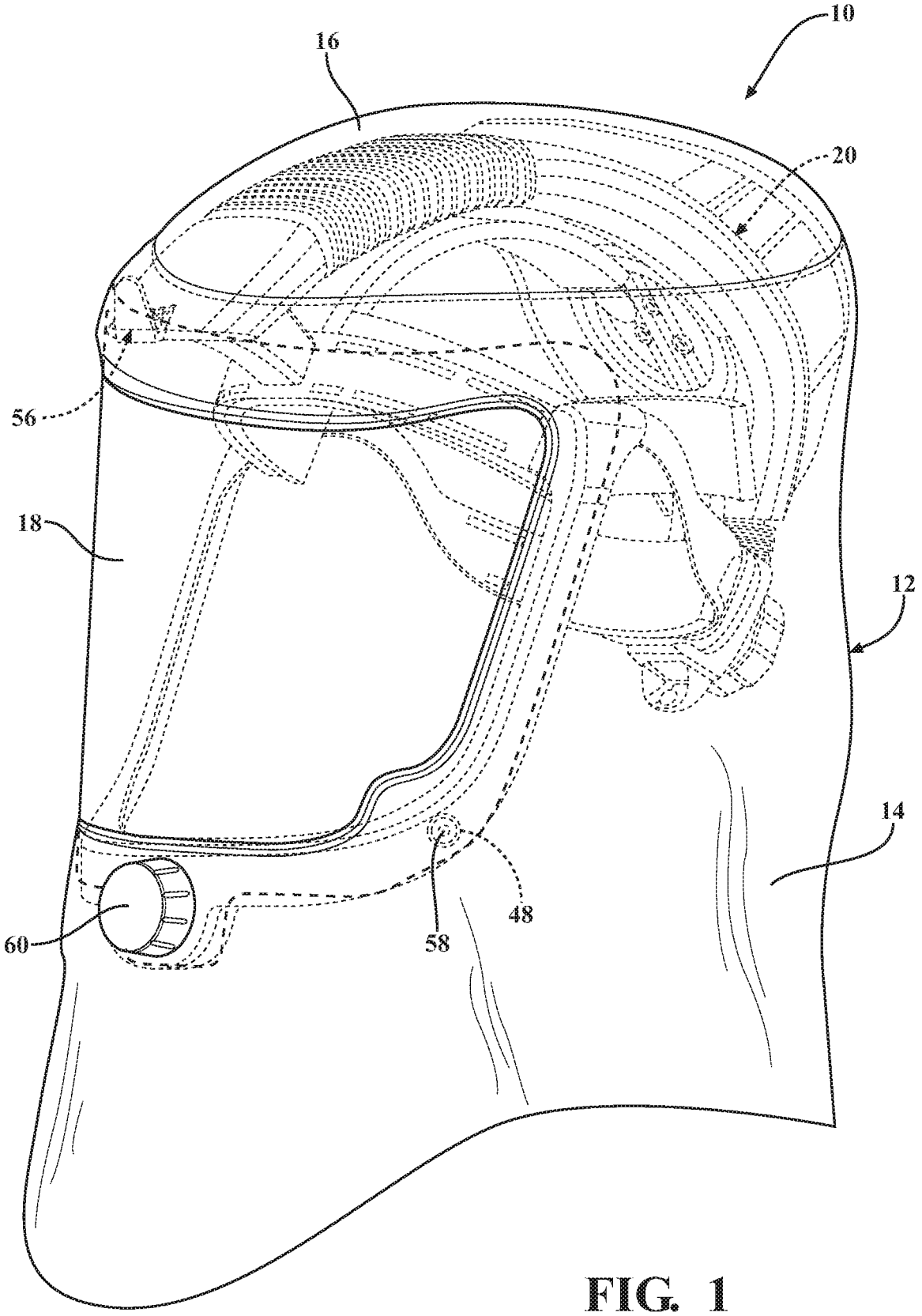
FIG. 1 is a perspective view of a protective apparel system that includes a surgical hood and a surgical helmet, with the surgical helmet shown in phantom.
Figure 2A:
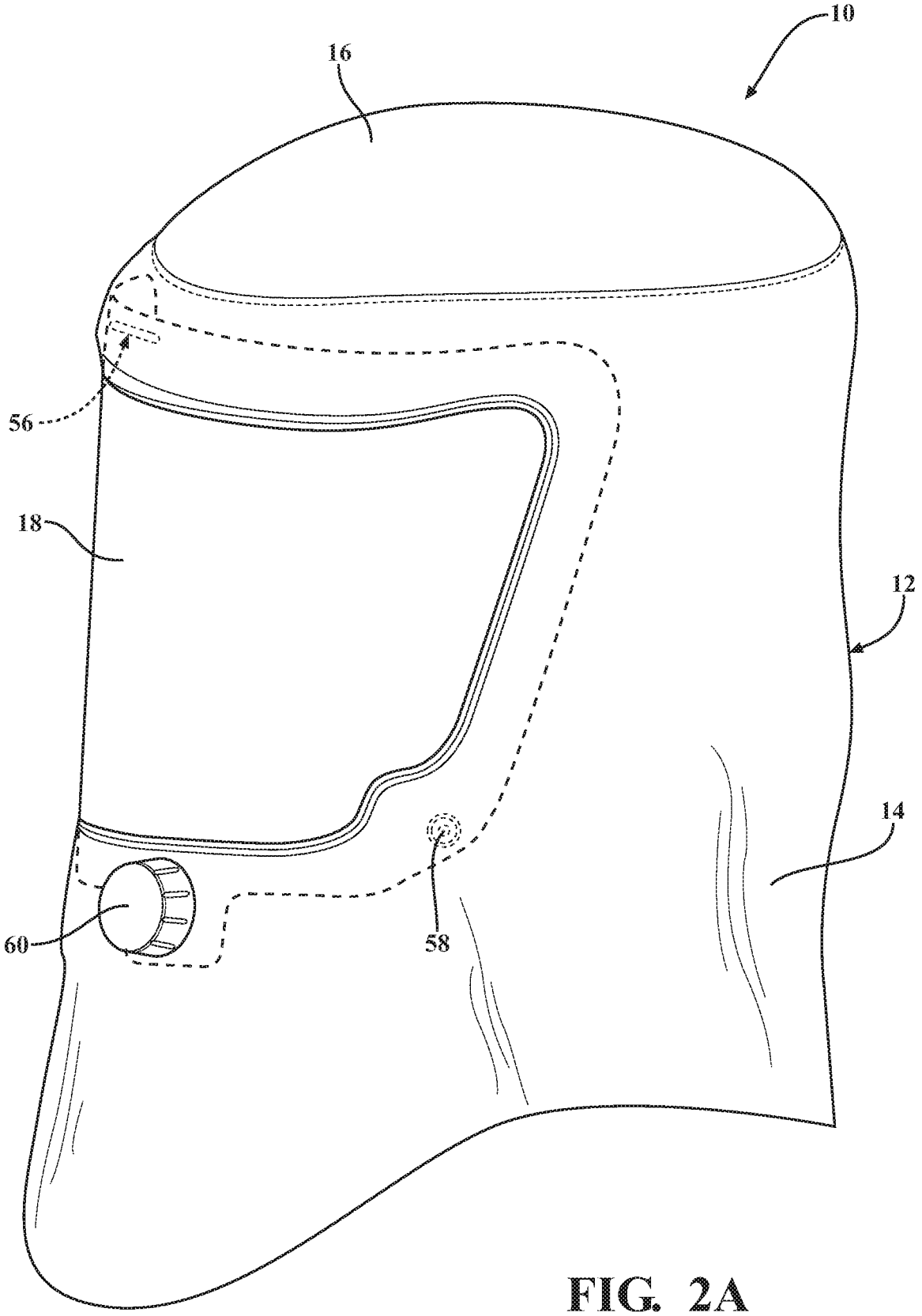
FIG. 2A is a perspective view of the surgical hood of the protective apparel system of FIG. 1, with a portion of the transparent face shield shown in phantom.

Referring to FIG. 2A, an example embodiment of a surgical garment 12 for use in the protective apparel system 10 of FIG. 1 is illustrated. The surgical garment 12 may include a fabric 14 configured to cover the surgical helmet 20 and at least a portion of the head of the wearer. As illustrated in FIG. 2A, the surgical garment 12 may be a hood. It will be understood that a hood 12 refers to a surgical garment 12 that covers the head and likely only extends a short distance below the neck when worn by the wearer. However, while not illustrated in the figures, it is further contemplated that the surgical garment 12 may be a toga, a shirt, or a jacket. It will be understood that toga refers to a surgical garment 12 that covers the head in the same manner as a hood and extends to at least the waist when worn by the wearer.

The surgical garment 12 may be manufactured from any suitable surgical fabric 14 or combinations of fabrics to help repel and/or absorb water, debris and other contaminants. The surgical fabric 14 may include multiple layers. One such layer may be a microporous film that allows gas to pass through the fabric while still maintaining the microbial barrier. In certain configurations, the surgical fabric 14 is one that satisfies ASTM F1670-98 standard for blood penetration resistance and/or the ASTM F1671-97B standard for viral penetration resistance. In one non-limiting example of the surgical fabric 14, the surgical fabric 14 of the surgical garment 12 has a pore size in the approximate range of 0.05 to 0.20 microns. However, other pore sizes for the surgical fabric are also contemplated.

It is further contemplated that the surgical garment 12 may be constructed of multiple different fabrics coupled to one another to define the barrier. For example, the surgical garment 12 may be primarily constructed from a barrier fabric 14 and a filter fabric 16. The filter fabric 16 may be more permeable, and hence, more breathable, than the barrier fabric 14 described above. The filter fabric 16 may be located in an area with a reduced risk of having a microbial particle cross the barrier, such as above the wearer's head or proximate the crown of the wearer's head, and configured to aid in the circulation of air through the barrier. The barrier fabric 14 may be attached to the filter fabric 16 using any suitable means, such as adhesive, sewing, or welding.

As illustrated in FIGS. 1 and 2, the surgical garment 12 may further comprise a face shield 18. The face shield 18 portion of the surgical garment 12 allows the wearer to see through the barrier provided by the surgical garment 12. The face shield 18 is generally a sheet-like structure and may have a thickness of approximately 1 mm or less. The face shield 18 may be mounted and/or attached to an opening or cut-out formed in the fabric 14 of the surgical garment 12. The fabric 14 may be attached around the periphery or edge of the face shield 18 by sewing, snaps, hook and loop, adhesive, welding, or combinations thereof. The face shield 18 may be constructed from a transparent material, such as a polycarbonate. One such polycarbonate is sold under the trademark LEXAN by Sabic. The face shield 18 of the surgical garment 12 may also be tinted to protect the wearer's eyes from heightened exposure to bright lights. Furthermore, the face shield 18 may be flexible such that the face shield 18 may be curved to accommodate different head sizes.

The face shield 18 may further comprise an opening 56 proximate to the top portion of the face shield 18. The opening 56, as illustrated in FIG. 2, is generally rectangular shaped. While not illustrated in the Figures, it is further contemplated that the opening 56 may be configured in the shape of a circle, oval, square, or any similar polygonal shape. The opening 56 may also be generally centered between the opposing ends of the face shield 18, and serve as an alignment element and/or centering feature. Furthermore, the opening 56 may be positioned on the face shield 18 above the point of attachment for the fabric 14 to the face shield 18, so as to ensure the fabric 14 covers the opening 56 to maintain the barrier provided by the surgical garment 12 between the wearer and the environment. For example, as illustrated in FIGS. 1 and 2, the fabric 14 of the surgical garment 12 is attached to the top of the face shield 18 at a location below the opening 56 of the face shield 18.

The surgical garment 12 may also include one or more garment fasteners 58 positioned about the surgical garment 12. The garment fasteners 58 are configured to releasably secure the surgical garment 12 to the surgical helmet 20. The garment fasteners 58 may take any suitable form, and may comprise metal tacks, rivets, buttons, magnets, hook and loop, snaps, or similar types of fasteners, alone or in combination. As illustrated in FIG. 2, the garment fasteners 58 may be mounted to the face shield 18 of the surgical garment 12 so as to extend inwardly from the wearer side of the face shield 18. While not shown, it is also contemplated that the garment fasteners 58 may be positioned at any position or location about the surgical garment 12, including being mounted to the barrier fabric 14 and/or the filtration fabric 16. The garment fasteners 58 may be mounted to the face shield 18 and/or fabric 14/16 via an adhesive, rivet, snap, or similar mounting device.

Figure 2B:
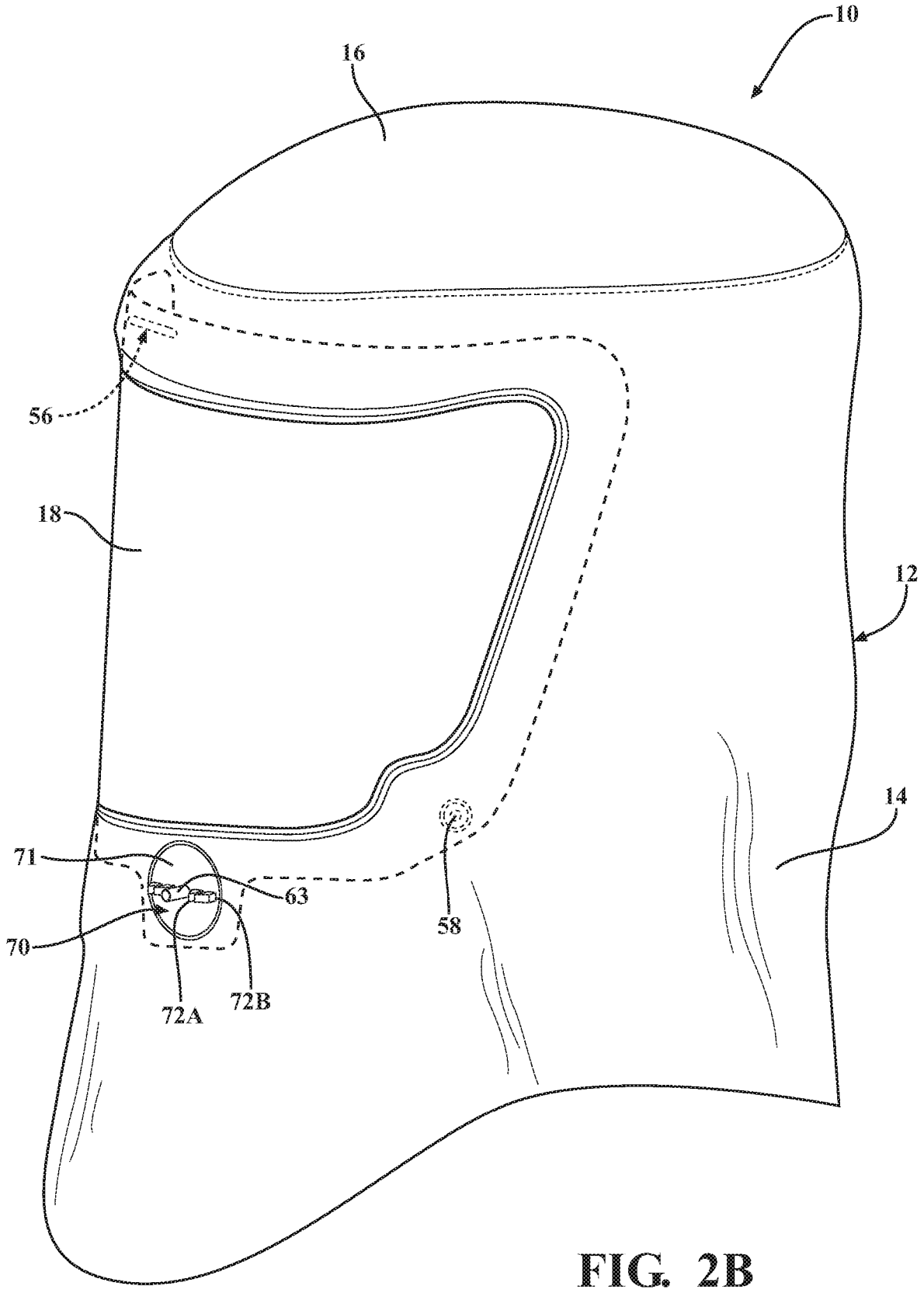
FIG. 2B is a perspective view of the surgical hood of the protective apparel system of FIG. 1, with a control mount shown integral with the face shield of the surgical hood.
Figure 2C:
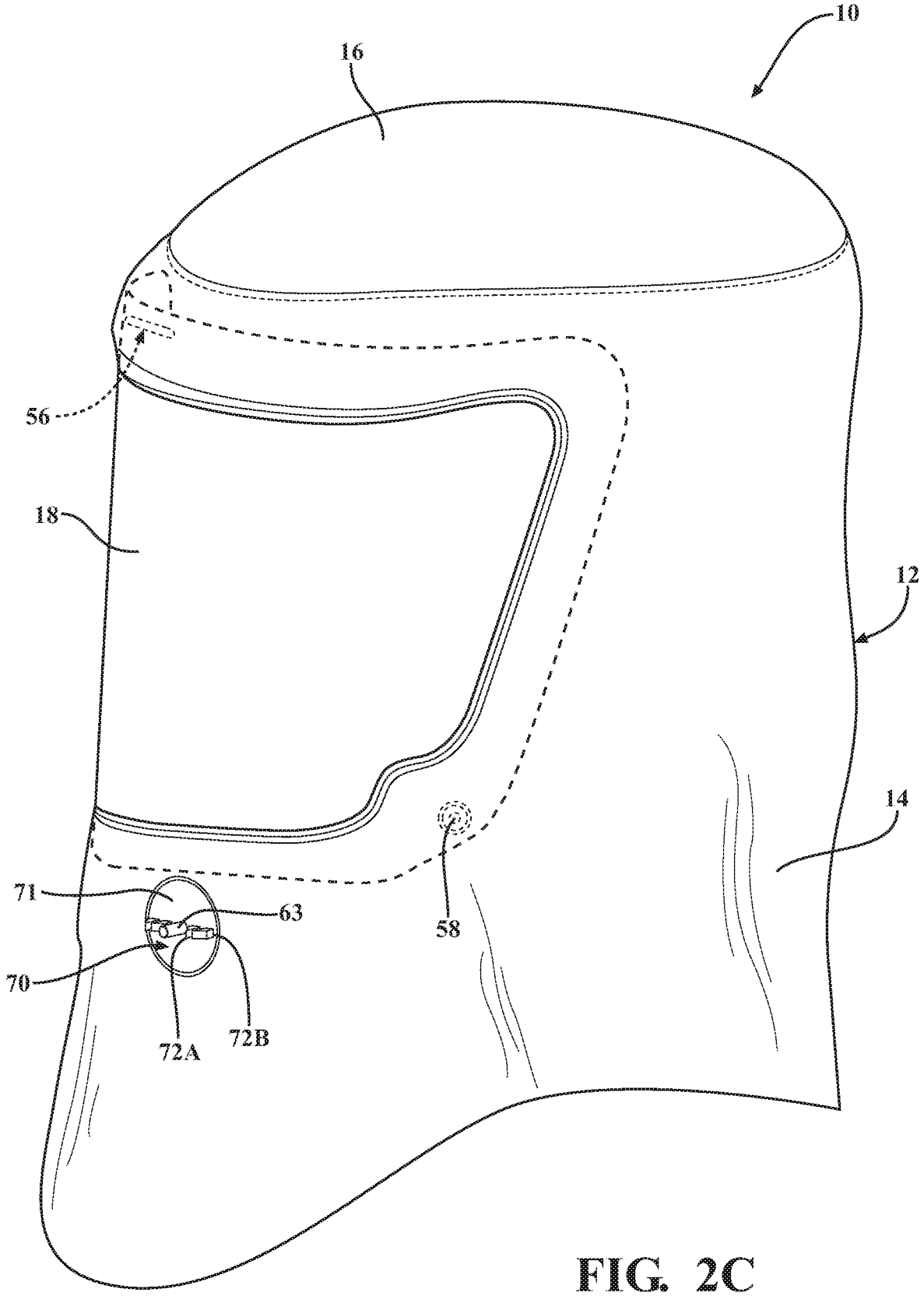
FIG. 2C is a perspective view of the surgical hood of the protective apparel system of FIG. 1, with a control mount shown integral with the fabric of the surgical hood.

Referring to FIGS. 2A-2C, the surgical garment assembly 12 may further comprise a control mount 70. The control mount 70 may be integral with the surgical garment 12 and configured to form at least a portion of the barrier defined by the surgical garment 12. Because the control mount 70 forms at least a portion of the surgical barrier, the control mount 70 may be potentially exposed to contaminants from the environment side and the wearer side of the surgical garment 12. As such, once the control mount 70 is mounted to the surgical garment 12, it acts as a barrier to prevent microbes from being transmitted between the environment side and the wearer side. The control mount 70 may be configured to be attached to the face shield 18 and/or the fabric 14/16 of the surgical garment 12. For example, as illustrated in FIG. 2B, the control mount 70 may be attached to the face shield 18 of the surgical garment 12. Alternatively, as illustrated in FIG. 2C, the control mount 70 may be attached to the fabric 14/16 of the surgical garment 12.

The control mount 70 may be attached to an opening or cut-out portion of the surgical garment 12 using various methods, including but not limited to, welding, adhesion, sewing, or the like. Referring to FIGS. 2B-2C, the control mount 70 may be attached to the surgical garment 12 by securing the fabric 14 or the face shield 18 to the periphery of the control mount 70. The manner in which the control mount 70 is attached to the fabric 14/16 and/or face shield 18 should provide similar resistance to the transfer of microbes through the barrier as the rest of the surgical garment 12. For example, the control mount 70 may be secured to the face shield 18 using an adhesive that satisfies the ASTM F1670-98 standard for blood penetration resistance and/or the ASTM F1671-97B standard for viral penetration resistance. Furthermore, the control mount 70 itself may be configured to prevent the transmission of microbes, fluid, and the like, therethrough. The control mount 70 may assume various shapes and sizes, and may comprises any suitable material, such as plastic. As such, it should be understood that the mount opening or cut-out in the surgical garment 12 may be modified relative to the size and shape of the control mount 70.

The control mount 70 may be configured to comprise one or more couplers on either side of the barrier defined by the surgical garment 12. For example, the control mount 70 may comprise one or more environment-side couplers 63 at least partially disposed on the environment side of the barrier. Similarly, the control mount 70 may comprise one or more wearer-side couplers 76 at least partially disposed on the wearer side of the barrier.

The control mount 70 may further comprise a body portion 71 and one or more lens portions 72A, 72B positioned within the body portion 71. In certain embodiments, the entire control mount 70, or only a portion of the control mount 70, may be transparent, such as only the lens portions 72A, 72B may be transparent, with the body portion 71 being opaque. The lens portions 72A, 72B may be integral with the body portion 71, or may be separate components from the body portion 71 which are attached to the body portion 71.

The lens portions 72A, 72B may be constructed of a transparent material, such as glass or polycarbonate, and configured to allow the transmission of light through the microbial barrier defined by the surgical garment 12, including through the control mount. Referring to FIGS. 2B-2C, the lens portions 72A/72B may be configured to extend or protrude outward from the body portion 71 of the control mount 70. The lens portions 72A/72B may also be configured to extend or protrude inward from the body portion 71 of the control mount 70.

Figure 5A:
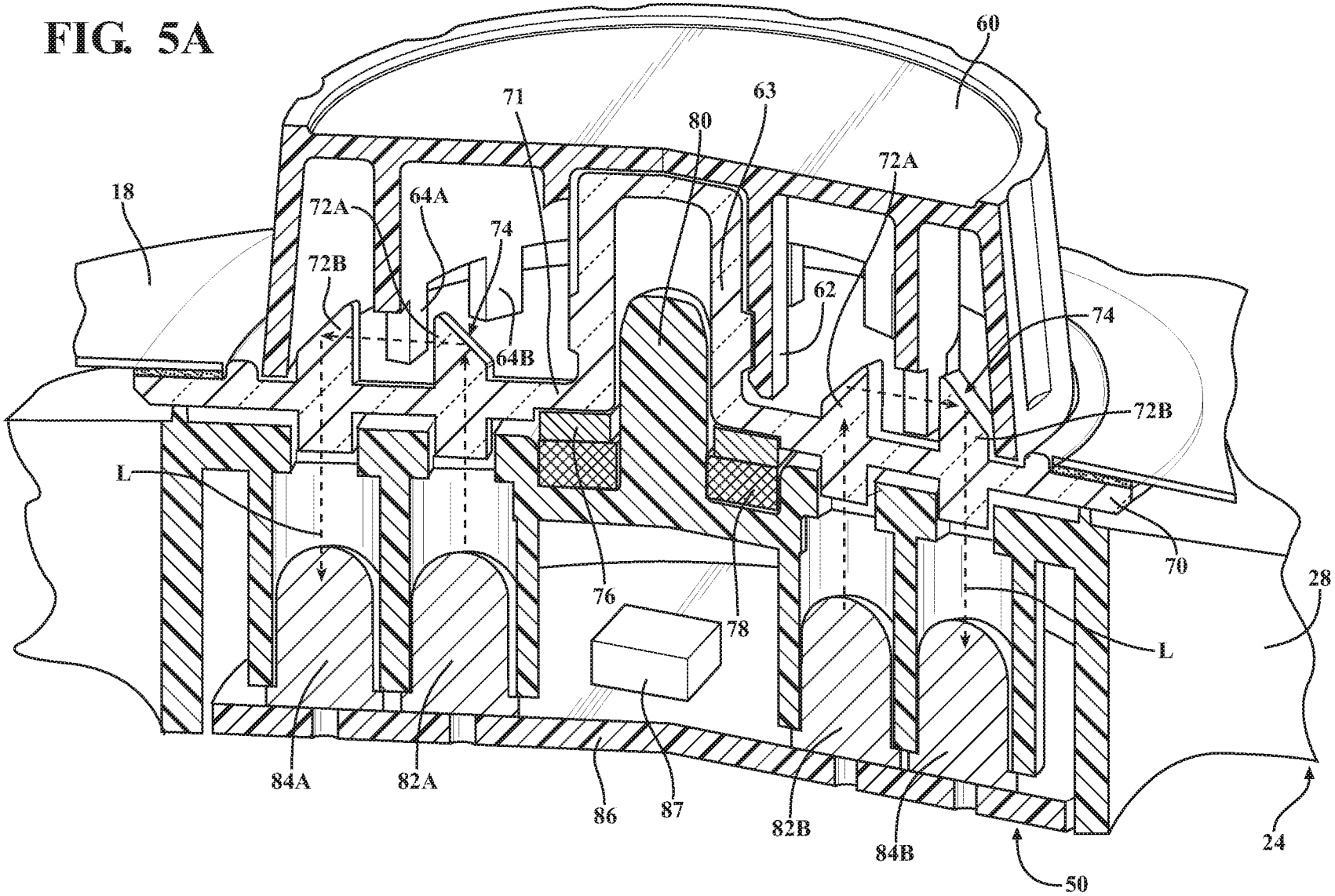
FIG. 5A is a close-up sectional view of a first embodiment of the control mount and control member of FIG. 4B.

Referring now to FIG. 5A, the lens portion 72A and lens portion 72B may each independently include an operative surface 74. The operative surface 74 may be configured to optimally direct, reflect and/or focus light transmitted therethrough. The operative surface 74 may have a shape to optimally direct, reflect, and/or focus light. Suitable shapes include curved, angled, beveled, or arc-shaped. The operative surface 74 may be finished or coated to improve its ability to direct, reflect, and/or focus light.

Referring again to FIGS. 1-3, an example embodiment of the protective apparel system 10 is described in greater detail. The system may include a surgical garment 12 and surgical helmet 20. The surgical garment 12 may be configured as a hood or a toga to be placed over the surgical helmet 20. In the hood configuration illustrated in FIGS. 1-3, the surgical garment 12 may be positioned over the surgical helmet 20 and configured to encompass the surgical helmet 20 and, correspondingly, the head of the person wearing the system 10, thereby covering the wearer's face and back of the head. Alternatively, if the surgical garment 12 were configured as a toga, the toga may be positioned over the surgical helmet 20 and configured to encompass the surgical helmet 20 and, correspondingly, the head, arms, shoulders, and torso of the person wearing the system 10. To place the surgical garment 12 over the surgical helmet 20, the surgical garment 12 will typically be turned inside out as the face shield 18 is aligned and affixed to the surgical helmet 20 in the manner described below. Once the face shield 18 is positioned relative to the surgical helmet 20, the remainder of the fabric will typically be pulled over the wearer's head to cover the exposed components of the surgical helmet 20 and the wearer's head.

Figure 3:
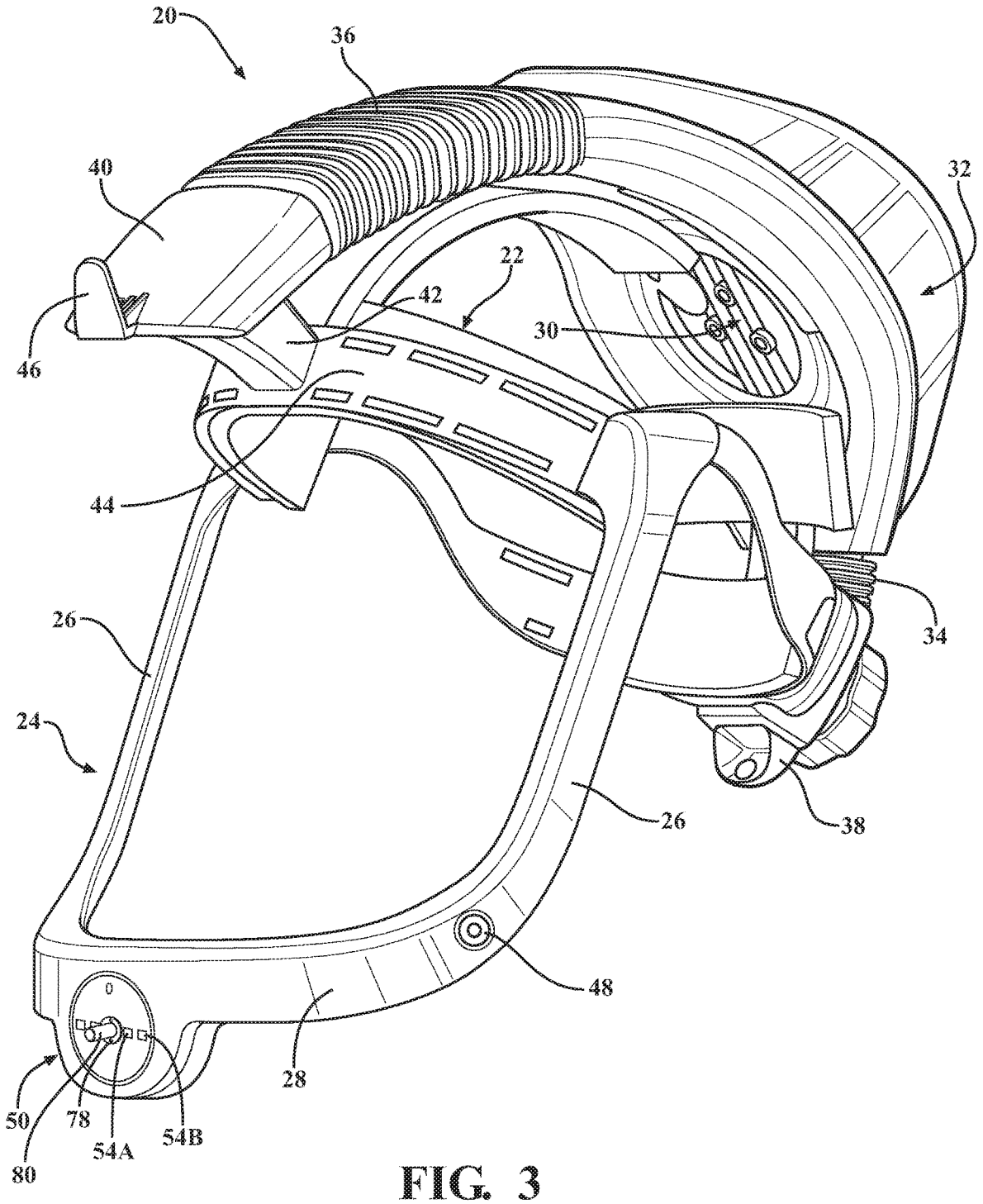
FIG. 3 is a perspective view of the surgical helmet of the protective apparel system of FIG. 1.

Referring to FIG. 3, an example embodiment of the surgical helmet 20 that may be utilized as part of the protective apparel system 10 is illustrated. The surgical helmet 20 in FIG. 3 includes a headband 22. The surgical helmet 20 further includes a shell 32 that is supported by and located above the headband 22. The shell may be configured in an arcuate shape to fit over the head of the individual wearing the personal protection system 10. Other helmet designs are contemplated.

Many portions of the shell 32 may be formed to define voids, or open interior spaces. For example, the shell 32 may comprise a center void. The center void may be located towards the rear of the shell 32. There may be an intake opening or aperture in the top portion of the shell 32 to provide access to the center void. The shell 32 may also include additional voids, such as a front void proximate to the front of the shell 32 and a rear void proximate to the rear of the shell 32. The additional voids may be configured to form duct-like structures or passageways within the shell 32. The additional voids may even be interconnected to the center void.

The surgical helmet 20 may include one or more electrically-powered peripheral devices 30, including but not limited to, a ventilation assembly, a light, a camera, microphone or other communication device, cooling device, or combinations thereof. These devices may be mounted to and/or attached at various locations and orientations relative to the surgical helmet 20. Each of the peripheral devices may be configured to receive commands that affect the operating state of the corresponding peripheral device. For example, each of the peripheral devices can receive on/off commands. Alternatively, the peripheral devices may receive commands that change one or more settings of the peripheral devices. Such configurations allow the wearer of the surgical helmet 20 to control the operating state of the various peripheral devices during the surgical procedure. In one specific example, when the peripheral device 30 is a ventilation assembly 30, the ventilation assembly 30 may be configured to receive various commands to control the actuation and/or adjust the speed of the fan in the ventilation assembly 30. Alternatively, when the peripheral device is a cooling device, the cooling device may be configured to receive commands to control the intensity of the cooling output provided by the cooling strip. When the peripheral device is a microphone, the microphone may be configured to receive commands to control the volume of the audible signal produced by the microphone. When the peripheral device is a light, the light may be configured to receive commands to control the direction and/or intensity of light emitted. The peripheral devices may of course be configured to be responsive to other types of commands that control the operation of the peripheral device.

Wearing the protective apparel system 10, including the surgical garment 12, over a wearer's head can inevitably result in the buildup of carbon dioxide and increased temperatures within the surgical garment 12 as a result of the wearer's normal breathing. An increase in temperature underneath the surgical garment 12 can also result in the buildup of water vapor on the wearer and/or the face shield 18, resulting in the wearer's view being obstructed. In order to prevent these undesirable effects, the surgical helmet 20 of the protective apparel system 10 may be configured for the attachment and/or inclusion of one or more peripheral devices 30 described above, such as the ventilation assembly, the cooling device, etc. Certain features of the surgical helmet, the peripheral devices, and the surgical garments may be found in one or more of the following U.S. Patents, which are hereby incorporated by reference: U.S. Pat. Nos. 6,481,019; 6,622,311; 6,973,677; 7,735,156; 7,752,682; 8,234,722; 8,282,234; 8,407,818; 8,819,869; and 9,173,437.

With reference to FIG. 3, the ventilation assembly 30 is one example of a peripheral device 30 that may be incorporated into the surgical helmet 20 of the protective apparel system. While the ventilation assembly 30 is shown as an integral component of the surgical helmet 20, it should be appreciated that each of the other peripheral devices described above may be either an integral component of the surgical helmet 20, or may be removably coupled to the surgical helmet 20. The surgical helmet 20 illustrated in FIG. 3 comprises the ventilation assembly 30 positioned within the center void of the shell 32. The ventilation assembly 30 may include a fan blade, impeller, propeller, fan wheel, or similar blade mechanism configured to induce air movement. The blade may be coupled to a motor configured to rotate the blade when energized by a power source. When the blade is actuated, the ventilation assembly 30 is configured to draw air into the center void of the shell 32 through the intake opening in the top of the shell 32. The additional voids of the shell 32 may be connected to the center void and serve as ducts for dispersing the air drawn into the center void.

The exemplary ventilation assembly 30 may include a front bellows 36 that extends forward from the front void in the front of the shell 32 and connects to a front nozzle 40. The front nozzle 40 may be mounted to the front of the headband 22. The ventilation assembly 30 may further include a rear bellows 34 that extends from the rear void in the rear of the shell 32 to a rear nozzle 38. The rear nozzle 38 may be mounted to the back of the headband 22. When the ventilation assembly 30 of the surgical helmet 20 is actuated, the fan draws air in through the surgical garment 12 into the opening in the top of the shell 32 and disperses the air outward through the additional voids. For example, the ventilation assembly 30 may be configured to draw air through the filter fabric 16 of the surgical garment 12. The air is then discharged through front 36 and rear bellows 34, respectively. The air that flows through the front bellows 36 is discharged through the front nozzle 40 in front of the face of the wearer. The air discharged through the front nozzle 40 may be discharged against the face shield 18 and/or on the face of the wearer. The air that flows through the rear bellows 34 is discharged through the rear nozzle 38. Rear nozzle 38 is positioned so as to open below the headband 22. The air discharged from the rear nozzle 38 can be discharged against the back of the neck of the wearer.

The front nozzle 40 of the surgical helmet 20 may include a block 42. The block 42 is the portion of the front nozzle 40 that is mounted to the headband 22 or a component of the surgical helmet 20 integral with the headband 22. In the illustrated version of the system 10, block 42 is mounted to a strap 44 that is part of the headband.

Front nozzle 40 may further be configured to include a tab 46. The tab 46 protrudes upwardly from the front edge of the nozzle 40. As seen in FIG. 3, the tab 46 protrudes outwardly from the top surface of the front nozzle 40.

The surgical helmet 20 may include a chin bar 24 that extends downwardly from the front of the headband 22. The chin bar 24 includes two posts 26 that extend from opposed sides of the headband 22. A beam 28 extends between the opposed free ends of the posts 26. Chin bar 24 is formed so that the beam 28 is located below and slightly forward of the chin of the person wearing the surgical helmet 20. The beam 28 may be bowed outwardly from the ends of posts 26. A plurality of magnets, hook and loop, metal rivets, snaps, or similar type fasteners 48 may be mounted to the chin bar 24 and configured to align and/or attach the face shield 18 of surgical garment 12. Each fastener 48 may be positioned on the chin bar 24 proximate the opposed free ends of the posts 26 and/or adjacent opposing ends of beam 28. Alternatively, the fasteners 48 of the surgical helmet 20 could be arranged or otherwise configured in any suitable way to cooperate with the complementary fasteners 58 of the face shield 18, as described above, to releasably secure the surgical garment 12 to the surgical helmet 20.

As described above, referring now to both FIG. 3 and FIG. 4A, in one embodiment, the face shield 18 may comprise an opening 56 proximate the top edge of the face shield 18. The opening 56 in the face shield 18 may be configured to receive the tab 46 protruding from the front nozzle 40 of the surgical helmet 20. The opening 56 and the tab 46 may configured to releasably secure the face shield 18 and/or surgical garment 12 to the surgical helmet 20. Furthermore, the opening 56 and the tab 46 may serve as an alignment feature configured to align the face shield 18 with the surgical helmet 20, such that the face shield 18 will be positioned in front of the wearer's face when system 10 is worn. While not shown in the Figures, it should be understood that it has been contemplated that the face shield 18 may include additional openings 56, and the surgical helmet 20 may be configured to include additional tabs 46 correspondingly arranged relative to the openings 56 of the face shield 18. For example, a plurality of tabs 46 may extend from the headband 22 and/or front nozzle 40, and the face shield 18 may be configured to include complementary openings 56 that releasably engage the plurality of tabs 46 when attaching the surgical garment 12 to the surgical helmet 20.

Furthermore, as described above, the face shield 18 and/or fabric 14 may comprise a plurality of fasteners 58 arranged about the surgical garment 12. In the example embodiment of the surgical garment 12 that is illustrated in FIGS. 1-2C, the fasteners 58 of the surgical garment 12 may be arranged and/or positioned on the face shield 18 so that, when the helmet tab 46 is seated in the opening 56 of the face shield 18, and the face shield 18 is flexed around the chin bar 24, each of the garment fasteners 58 will abut and latch to a complementary magnet or other suitable fastener 48 on the surgical helmet 20. Referring back to the example embodiment of the system 10 illustrated in FIG. 1, the surgical garment 12 comprises the opening 56 proximate to the top portion of the face shield 18 and a pair of fasteners 58 on opposing sides of the lower portion of the face shield 18. The metal tacks 58 may be spaced along the lower portion of the face shield 18 to matingly engage complementary magnets 48 on the chin bar 24 of the surgical helmet 20. In operation, once the opening 56 in the face shield 18 is seated on the tab 46 of the surgical helmet 20, the face shield 18 may then be flexed around the surgical helmet 20 to matingly engage the fasteners 58 on the lower portion of the face shield 18 to the complementary fasteners 48 on the chin bar 24 of the surgical helmet 20. The size of the face shield 18, as well as the spacing and/or position of the fasteners 58 on the surgical garment 12 may be changed to alter the curvature and/or shape of the face shield 18 when attached to the surgical helmet 20. For example, the fasteners 58 on the surgical garment 12 may be spaced closer together to reduce the curvature of the face shield 18 when it is attached to the surgical helmet 20. Alternatively, the fasteners 58 on the surgical garment 12 may be spaced farther apart to increase the curvature of the face shield 18 when it is attached to the surgical helmet 20. Altering the curvature of the face shield 18 may help to reduce glare of provide an expanded/reduced peripheral view through the face shield 18. While not illustrated in the Figures, it should be understood that alternative embodiments for securing the surgical garment 12 and/or face shield 18 to the surgical helmet 20 are also contemplated. For example, in one alternative embodiment, the face shield 18 may include the rectangular opening 56 proximate the top of the face shield 18 for mounting the surgical garment 12 to a tab 46 on the surgical helmet 20 as described above. However, instead of having the one or more fasteners 58, such as magnets or magnetic rivets, positioned proximate to the bottom of the face shield 18 and configured to couple the face shield 18 to the chin bar 24, the one or more fasteners 58 may be positioned proximate the top of the top of the face shield 18 and configured to removably couple the face shield 18 to the headband 22 or shell 32 of the surgical helmet 20. Alternatively, the face shield 18 may not include a rectangular opening 56, but instead comprise only a plurality of magnets or similar fasteners 58 spaced about the face shield 18 and/or surgical garment 12 and configured to couple to complementary magnets or similar fasteners 48 spaced about the surgical helmet 20. For example, the complementary magnets or similar fasteners 48 may be secured to the shell 32, headband 22, and/or chin bar 24. The surgical garment 12 and the surgical helmet 20 of the protective apparel system 10 described above are typically removably coupled to allow for disposal of the surgical garment 12 and reuse of the surgical helmet 20 following a procedure or exam.

With reference to FIG. 3, the surgical helmet 20 may further comprises a control housing 50. In one exemplary embodiment, the control housing 50 is shown as part of the chin bar 24. While the control housing 50 is formed as part of the beam 28 of the chin bar 24 in the illustrated embodiment, it is further contemplated that the control housing 50 may be formed as an integral part of, or be coupled to, other portions of the surgical helmet 20. For example, the control housing 50 may be an integral part of, or be coupled to, the headband 22, shell 32, front nozzle 40, and/or either post 26 of the chin bar 24.

The control housing 50 (FIG. 3) is configured to secure the control mount 70 of the surgical garment assembly 12 (FIGS. 2B and 2C) to the surgical helmet 20. The control housing 50 may be configured to include one, two, or more apertures 54A, 54B, as well as one or more coupling devices 78. The control housing 50 may also include one or more alignment features 80. The alignment feature 80 may comprise a protrusion extending from the control housing 50, as illustrated in FIG. 3. Alternatively, the alignment feature 80 may also include a recess in situations where the control mount includes a corresponding protrusion. The control housing 50 may also be configured to accommodate one or more emitters and/or user input sensors as will be described in detail below.

Figure 4A:
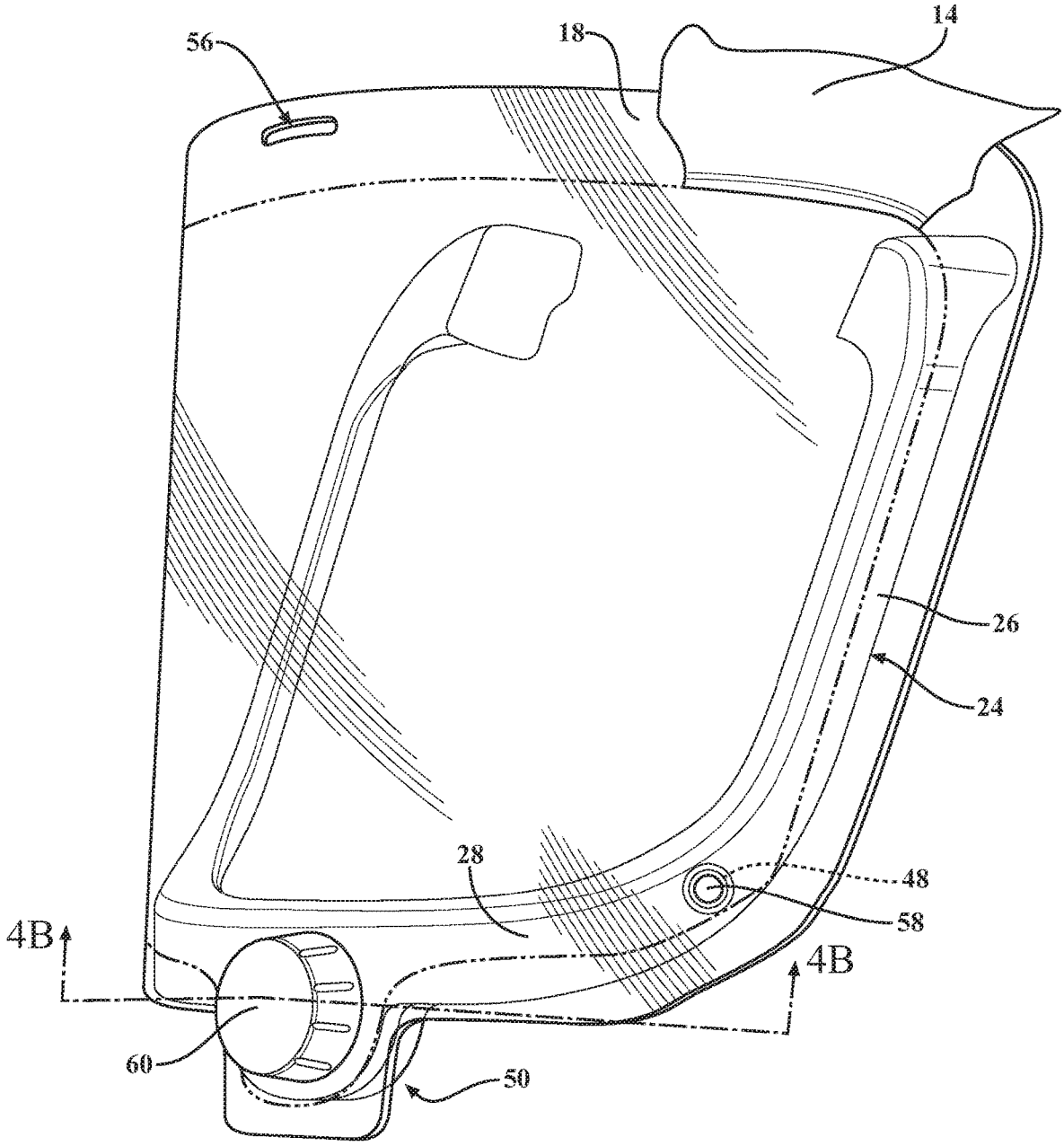
FIG. 4A is a partial perspective view of the surgical garment coupled to a chin bar of the surgical helmet shown in FIG. 1.
Figure 4B:
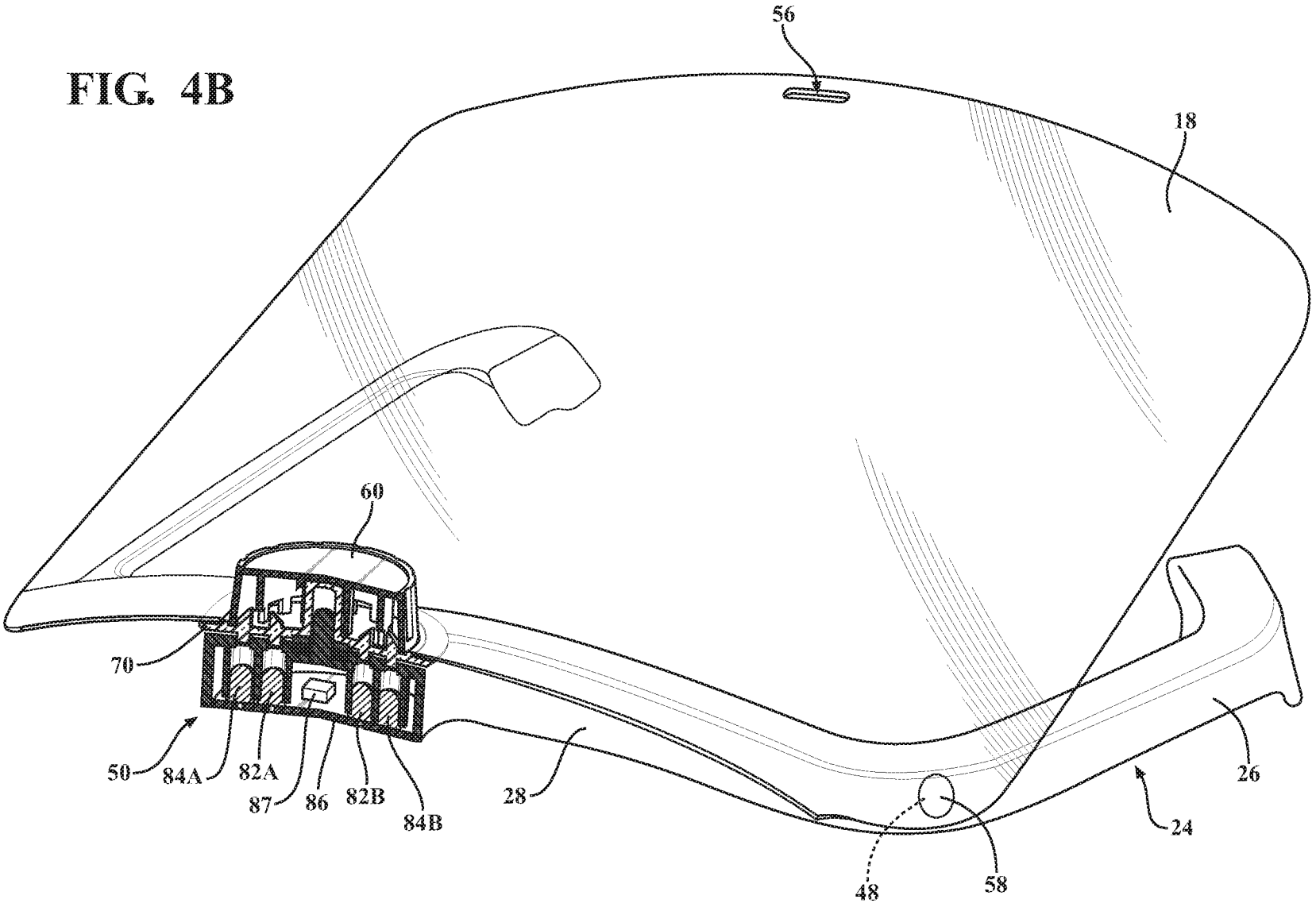
FIG. 4B is a partial perspective view of the surgical garment coupled to the chin bar of the surgical helmet of FIG. 4A, including a sectional view of the control mount and control member.

Referring to FIGS. 4A-4B, the control housing 50 may be configured to accommodate one or more emitters 82 and/or user input sensors 84. Referring specifically to FIG. 4B, a section view of the control housing 50 is illustrated including an emitter 82 and user input sensor 84 partially encased within the control housing 50. The emitter 82 may comprise a device configured to emit a signal. In the illustrated embodiment, the emitter is a light source, such as an LED light source. However, in other embodiments, the emitter 82 may be a magnetic field emitter, an electromagnetic field emitter, etc., such as a hall-effect emitter, an RF emitter, ultrasonic emitter, a capacitance emitter, a radar emitter, etc.

The user input sensor 84 may be a device configured to sense the signal emitted by the emitter 82. In the illustrated embodiment, the user input sensor 84 is an optical sensor configured to detect the presence, absence, and/or changes in intensity of light. However, in other embodiments, the user input sensor may be a hall-effect sensor, a RF sensor, radar sensor, ultrasonic sensor, capacitance sensor, etc.

In certain embodiments, particularly those using an optical sensor and an optical emitter, the emitter 82 and user input sensor 84 may be positioned within the control housing 50 such that they each align with one of a plurality of apertures 54A, 54B in the control housing 50 (FIG. 3). For example, the emitter 82 may be arranged and/or aligned relative to a first aperture 54A in the control housing 50, wherein the emitter 82 is configured to emit the optical signal outward from the control housing 50 through the first aperture 54A. Similarly, the user input sensor 84 may be arranged and/or aligned relative to a second aperture 54B in the control housing 50, wherein the user input sensor 84 is configured to detect the optical signal entering the control housing 50 through the second aperture 54B. The apertures 54A, 54B may be sealed to allow light passing therethrough, but prevent fluid from entering the apertures. This sealing may be accomplished with a suitable optical grade adhesive, such as an epoxy.

Figure 5B:
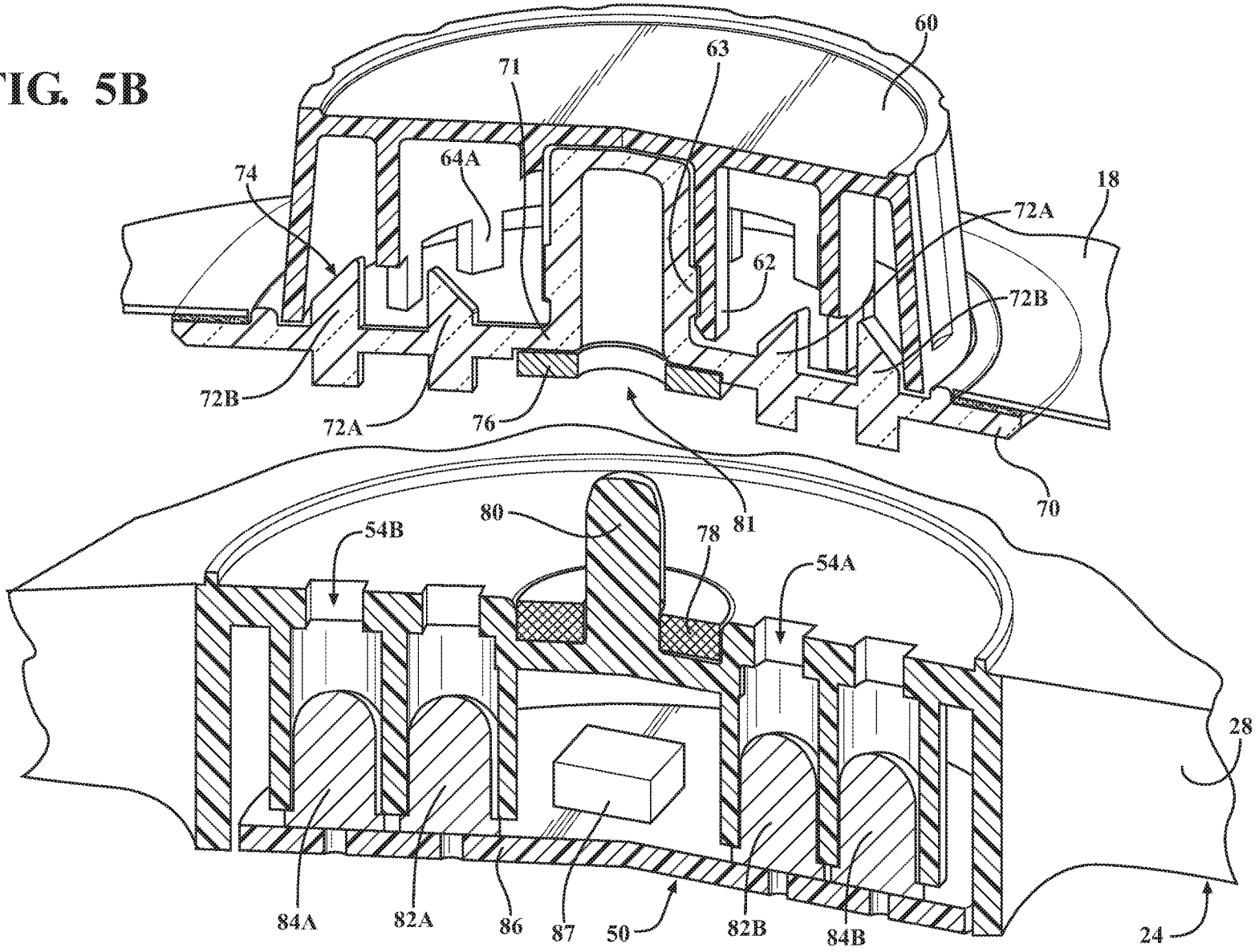
FIG. 5B is a partially exploded sectional view of the first embodiment of the control mount and control member of FIG. 5A.

Furthermore, the surgical helmet 20 may include a printed circuit board 86 to control the emitter 82 and user input sensor 84, and thus, depending on the embodiment, the emitter 82 and user input sensor 84 may be in electrical communication with the printed circuit board 86. The printed circuit board 86 may be partially disposed in the control housing 50. The printed circuit board 86 may be configured to serve as the rear outer wall of the control housing 50, as illustrated in FIG. 4B. Referring to FIGS. 5A-5B, the printed circuit board 86 may include a controller 87 for controlling the operation of the emitter 82 and user input sensor 84. The operation of the emitter 82 and user input sensor 84 with relation to the controller 87 will be discussed in greater detail below. The printed circuit board 86 may in communication with a power source, such as a battery, which may be located in the control housing or at other locations on the surgical helmet 20, or worn elsewhere on the wearer's body.

With reference to FIG. 5A, the control mount 70 may comprise one or more wearer-side couplers 76 at least partially disposed on the wearer side of the barrier. The coupling device 78 of the control housing 50 may be configured to releasably engage the wearer side coupler 76 of the control mount 70 to attach the control mount 70 to the control housing 50. In the exemplary embodiment illustrated in FIG. 5A-5B, coupling device 78 comprises a magnet configured to engage the wearer side coupler 76, which comprises a metal element, such as a washer, constructed of a ferrous alloy. Alternatively, the wearer side coupler 76 may comprise a magnet and the coupling device 78 may comprise a metal element. In yet another exemplary embodiment, both the coupling device 78 and wearer side coupler 76 may comprise complementary magnets configured to attract one another when the control mount 70 is attached to the control housing 50. It is also contemplated that the coupling device 78 and the wearer side coupler 76 may include a hook and loop, snap-fit, or other suitable coupling arrangements.

Referring to FIG. 5B, as described above, the control housing 50 also comprises the housing alignment feature 80. The control mount 70 may similarly comprise a mount alignment feature 81. The mount alignment feature 81 is illustrated as a recess positioned on the wearer side of the control mount 70 and configured to engage the housing alignment feature 80. The size and shape of the housing alignment feature 80 may be configured to correspond to the size and shape of the mount alignment feature 81. For example, the housing alignment feature 80 may comprises a protrusion extending from the control housing 50 wherein the protrusion is tapered from the outer tip down to the base, proximate the control housing 50. This may serve to aid the wearer in engaging the housing alignment feature 80 with the mount alignment feature 81. Furthermore, the diameter or dimensions of the housing alignment feature 80 may be configured to correspond to the diameter or dimensions of the mount alignment feature 81. For example, the diameter of the housing alignment feature 80 may be configured to fit snuggly within the corresponding mount alignment feature 81, or vice versa. The housing alignment feature 80 is illustrated as a round protrusion in FIGS. 5A-5B that corresponds to a round aperture serving as the mount alignment feature 81. In alternative embodiments, the housing alignment feature 80 and corresponding mount alignment feature 81 may be configured in the shape of a circle, oval, square, or similar polygonal shape. The size and/or dimension of the housing alignment feature 80 and the mount alignment feature 81 may serve to laterally align the control mount 70 and the control housing 50 relative to one another to ensure that proper alignment of the surgical garment 12 relative to the surgical helmet 20, or more specifically, to ensure proper alignment of the emitters 82 and user input sensors 84 relative to the control mount 70. The shape of the housing alignment feature 80 and the mount alignment feature 81 may serve to rotationally align the control mount 70 and the control housing 50 relative to one another. In operation, when the control mount 70 is coupled to the control housing 50, the housing alignment feature 80 may slidingly engage the complementary mount alignment feature 81.

As described above, the control mount 70 may further comprise an environment-side coupler 63. The environment side coupler 63 may be configured to operably couple a control member 60 to the control mount 70. Once coupled to the control mount 70, the control member 60 may be configured to be manipulated by the wearer from the environment side of the barrier formed by the surgical garment 12, with the wearer's hands. Accordingly, the control member 60 remains disposed on the environment side of the barrier. The control member 60 may be configured to be any suitable manipulandum, such as a rotation knob (see, e.g., 60 in FIGS. 5A-5B, 360 in FIGS. 8A-8C, 460 in FIG. 8D, 560 in FIGS. 9A-9C, and 660 in FIG. 10A-10C). Alternatively, the control member may be configured to be a wheel, lever, slider, or similar member capable of being manually manipulated by the wearer, such as with the wearer's hands. For example, the control member may be configured as slider (see, e.g., 160 in FIGS. 6A-6B and 260 in FIGS. 7A-7B), which will be described in greater detail below. In another exemplary embodiment, the control member 60 may be configured as a wheel or other rotatable device (see, e.g., 760 in FIG. 11), which will be described in greater detail below.

The control member 60 may comprise an attachment member 62 configured to operably engage the environment side coupler 63 of the control mount 70. For example, as illustrated in FIG. 5A-5B, the attachment member 62 may include a recess configured to receive a protrusion of the environment side coupler 63 to create a snap-fit engagement. Alternatively, the attachment member 62 may include a protrusion configured to extend into a recess of the environment side coupler 63. While not illustrated in the Figures, it should be understood that other similar coupling devices may be utilized to operably attach the control member 60 to the control mount 70. For example, the attachment member 62 and the environment side coupler 63 may include complementary magnets, friction fit, pin through an aperture, or similar complementary coupling arrangements.

The interaction of the attachment member 62 and the environment side coupler 63 should be configured to allow movement of the control member 60 relative to the control mount 70 in one or more degrees of freedom, while preventing the control member 60 from inadvertently decoupling from the control mount 70 during the surgical procedure. For example, in the embodiment shown in FIG. 5B, engagement of the environment-side coupler 63 and the attachment member 62 allow the control member 60, shown as a knob, to rotate relative to the control mount 70. In alternative embodiments, as will be described below, the control member 60 may take the form of a slider, with the attachment member and the environment side coupler configured to allow slidable movement of the control member 60 relative the control mount 70. The control member 60 may be attached during manufacture, or may be attached before the start of the surgical procedure in the operating room.

While not illustrated in the Figures, it should be understood that alternative embodiments for coupling the surgical helmet 20 to the control member 60 are contemplated. For example, the control mount may positioned on the surgical helmet that is configured to extend from the wearer side of the barrier to the environment side of the barrier by passing through or pressing against the fabric. The end of the post extending through to the environment side of the barrier may comprise a coupling mechanism configured to operably attach the control member to the post. In such an embodiment, the control mount may be separate from the surgical garment.

The control member 60 may further comprise one or more encoder elements 64. The encoder element 64 may extend from an interior surface of the control member 60. The encoder element 64 may be spaced or positioned about the control member 60 in a defined pattern or configuration such that when the control member 60 is actuated, the user input sensor 84 may detect the position and velocity of the control member 60 relative to the user input sensor 84. In an exemplary embodiment illustrated in FIGS. 5A-5B, there are a plurality of encoder elements 64 in the form of tabs extending from the interior surface of the control member 60. When the control member 60 takes the form of a knob, the plurality of encoder elements 64 may be spaced about a central axis of the control member 60 in a generally circumferential pattern spaced from the central axis. The encoder elements 64 may be spatially arranged in a predetermined manner, such as spaced a predetermined distance from one another.

The encoder elements 64 may be constructed of an opaque material, a translucent material, or some combination thereof. For example, each encoder element 64 may be constructed entirely of an opaque material or a translucent material. Alternatively, each encoder element 64 may be constructed of a combination of opaque material and/or translucent material. For example, in an exemplary embodiment, a first portion of the encoder element 64 may be constructed of the opaque material and a second portion of the encoder element 64 may be constructed of the translucent material. If other embodiments, the encoder elements 64 may take the form of emitters, such as magnetic field emitters, ultrasonic emitters, etc. Generally, the encoder elements can be any suitable feature of the control member that allows the user input sensor to determine the position and/or movement direction of the control element relative to the user input sensor.

As described above, the control mount 70 may include one or more lens portions 72A, 72B that are configured to allow the transmission of light through the barrier. The lens portions 72A/72B may be configured to extend toward the environment side of the surgical garment 12. The lens portion 72A and lens portion 72B may each independently include an operative surface 74. The operative surface 74 may be configured to optimally direct, reflect and/or focus light transmitted therethrough such that the lens portions 72A, 72B can more efficiently direct light and/or correct light to the corresponding lens portion. For example, as illustrated in FIGS. 5A-5B, the operative surface 74 of each lens portion 72A, 72B may be angled to reflect light from the first lens portion 72A to the second lens portion 72B. The operative surface 74 may be angled at approximately 45 degrees to optimally reflect light between the first lens portion 72A and the second lens portion 72B. It is also contemplated that the encoder elements described above may include an operative surface to optimally direct, reflect, and/or focus light transmitted to the encoder elements.

Referring to FIGS. 5A-5B, and exemplary embodiment of a control mount including a first lens portion 72A and a second lens portion 72B. The first lens portion 72A and the second lens portion 72B may be constructed of a transparent material, such as glass or polycarbonate, and configured to allow the transmission of light through the control mount 70. The first lens portion 72A and the second lens portion 72B may be positioned adjacent one another and be configured to extend toward the control member 60 when the control member 60 is coupled to the control mount 70. The outermost portion of the first lens portion 72A and the second lens portion 72B may comprise an operative surface 74 configured to reflect light between the first lens portion 72A and the second lens portion 72B. For example, the operative surface 74 the first lens portion 72A and the second lens portion 72B are configured to optimally redirect light between the first lens portion 72A and the second lens portion 72B. When the control member 60 is attached to the control mount 70, the encoder element(s) 64 of the control member 60 may be positioned and/or arranged on the control member 60 to pass between the first lens portion 72A and the second lens portion 72B when the control member 60 is manipulated by the wearer.

Depending on the configuration of the encoder element(s) 64, and the configuration of the operative surfaces of those the encoder elements 64, the encoder element may disrupt, absorb, reflect, and/or distort the light being directed from the first lens portion 72A such that the second lens portion 72B receives the modified light. For example, if the encoder element 64 is constructed from an opaque material, the encoder element 64 may disrupt the light being outputted from the first lens portion 72A. If the encoder element 64 is constructed from a translucent material, the encoder element 64 may distort the light being transmitted from first lens portion 72A such that second lens portion 72B receives the distorted light. Furthermore, if the encoder element 64 includes portions constructed from both an opaque material and a translucent material, the encoder element 64 may both disrupt and/or distort the light being redirected between the first lens portion 72A and the second lens portion 72B depending on which portion of the encoder element is between the first lens portion 72A and the second lens portion 72B at the time that light is transmitted therethrough.

The housing alignment feature 80 and the mount alignment feature 81 may be configured to position the control mount 70 relative to the control housing 50 such that the one or more apertures 54 in the control housing 50 may be aligned with each lens portion 72 of the control mount 70. This may also serve to align the various lens portions of the control mount 70 with an emitter 82 and/or user input sensor 84 in order to allow for the transfer of light from the emitter 82 through barrier defined by the surgical garment 12 and back to the user input sensor 84. For example, the first lens 72A may be configured to transfer light from the emitter 82 through the barrier defined by the surgical garment 12. The operative surface 74 of the first lens 72A may be configured to redirect the light to the second lens 72B. An operative surface 74 of the second lens 72B may be configured to redirect the light along the second lens 72B and back through the barrier to the user input sensor 84. The encoder elements 64 of the control member 60 may be configured to pass between first lens portion 72A and the second lens portion 72B of the control mount 70 when the control member 60 is manipulated. When each encoder element 64 passes between the first lens portion 72A and the second lens portion 72B, the encoder element(s) 64 may disrupt and/or distort the transfer of light between the second lens portion 72B and the first lens portion 72A. The user input sensor 84 may be configured to detect the disruption and/or distortion of the light passing through the lens portion 72A. In embodiments where the sensor is a non-optical sensor and non-optical emitter, such as a hall-effect sensor and corresponding emitter, the helmet alignment feature 80 and the mount alignment feature 81 the may also serve to align an magnetic emitter on the control member with the hall effect sensor disposed on the surgical helmet 20, such as on the control mount 70.

Referring to FIG. 5A-5B, the first lens portion 72A may be aligned with the first aperture 54A of the control housing 50, and a second lens portion 72*b* may be aligned with the second aperture 54B of the control housing 50. The first lens portion 72A and the second lens portion 72B are generally aligned with one another and are spaced apart a distance sufficient to allow the encoder element 64 of control member 60 to pass between the adjacent lens portions 72A/72B when the control member 60 is manipulated by the wearer. As illustrated in FIG. 5A-5B, the control mount 70 may comprise additional pairs of first lens portions 72A and second lens portions 72B. Each lens portion 72A/72B includes an operative surface 74 configured to reflect and/or redirect light between the adjacent lens portions 72A/72B.

In operation, the emitter 82 (see, e.g., emitters 82A, 82B in FIGS. 5A and 5B) may be in the control housing of the surgical helmet. For example, the emitter 82 may be positioned proximate a first aperture 54A of the control housing 50 that is aligned with a first lens portion 72A of the control mount 70. The emitter 82 may then be configured to emit light to be transferred through the first lens portion 72A and across the barrier defined by the control mount 70. The light may then be redirected by the operative surface 74 of the first lens portion 72A toward a second lens portion 72B. The light will be received by the operative surface 74 of the second lens portion 72B and be redirected along the length of the second lens portion 72B back through the barrier. The second lens portion 72B may be aligned with a second aperture 54B in the control housing 50, such that the light will be directed through the second aperture 54B and received by a user input sensor 84 (see, e.g., user input sensors 84A, 84B in FIGS. 5A and 5B) positioned within the control housing 50 proximate the second aperture 54B. When the wearer manipulates the control member 60, the one or more encoder elements 64 (see, e.g., emitters 64A, 64B in FIGS. 5A and 5B) will pass between the first lens portion 72A and the second lens portion 72B. When the encoder element 64 passes between the first lens portion 72A and the second lens portion 72B, the encoder element 64 may disrupt or distort the light between transmitted between the first lens portion 72A and the second lens portion 72B, depending on the configuration of the encoder element 64. For example, wherein the control member 60 includes an opaque encoder element 64 as described above, when the encoder element 64 passes between the first lens portion 72A and the second lens portion 72B, the reflection of light will be disrupted and prevented from passing between the first lens portion 72A and the second lens portion 72B. Therefore, when the wearer manipulates the control member 60, one or more encoder elements 64 may pass between the first lens portion 72A and the second lens portion 72B. The user input sensor 84 may configured to detect the presence and/or absence of light received by the second lens portion 72B, and generate an output signal based on the presence and/or absence of light.

Alternatively, in an embodiment wherein the control member 60 includes a translucent encoder element 64 as described above, when the encoder element 64 passes between the first lens portion 72A and the second lens portion 72B, the reflection of light will be distorted as it passes between the first lens portion 72A and the second lens portion 72B. The user input sensor 84 may configured to detect the changes in intensity of light received by the second lens portion 72B and transmitted to the user input sensor 84, and generate an output signal based on the changes in intensity of light.

In yet another embodiment wherein the control member 60 includes an encoder element 64 constructed from a combination of opaque and translucent materials as described above, the reflection of light will be disrupted and prevented from passing between the first lens portion 72A and the second lens portion 72B when the opaque portion of the encoder element 64 passes between the first lens portion 72A and the second lens portion 72B, and the reflection of light will be distorted when the translucent portion of the encoder element 64 passes between the first lens portion 72A and the second lens portion 72B. The user input sensor 84 may be configured to detect the presence of, absence of, and/or changes in intensity of light received by the second lens portion 72B and transmitted to the user input sensor 84, and generate an output signal based on the presence of, absence of, and/or any changes in intensity of light.

As described above, and with reference to FIG. 5A, the printed circuit board 86 may comprise a controller 87 coupled to the surgical helmet 20. It should be understood that the controller 87 may be positioned anywhere on the surgical helmet 20. For example, the controller 87 may be positioned within the control housing 50. Alternative, the controller 87 may be positioned within a void in the shell 32 of the surgical helmet 20.

The controller 87 may be configured to output operational commands to the emitter 82, as well as configured to receive a signal from the user input sensor 84 related to a characteristic of the signal detected by the user input sensor 84. The controller 87 may also be connected to the peripheral devices 30 of the surgical helmet 20, wherein the controller 87 is configured to send operational commands to the ventilation assembly 30, or other peripheral device based on the signal received from the user input sensor 84. For example, the controller 87 may be configured to adjust the power output to the ventilation system 30 to control the speed of the fan blade. It is contemplated that two separate controllers may also be utilized, one to control the peripheral device and one to control the sensor and emitter.

Regardless of the encoder element 64 configuration, the user input sensor 84 may be configured to generate an output signal to send to the controller 87 based on the presence of, absence of, and/or changes in the signal, such as intensity of light, received by the user input sensor 84. The controller 87 may be configured to output a command to a peripheral device 30 based on the user input signal received from the user input sensor 84. For example, when the control member 60 is manipulated by the wearer, one or more encoder elements 64 may pass between the first lens portion 72A and the second lens portion 72B. Based on the material, size, and/or spacing of the encoder elements 64, a pattern of light signals indicative of the wearer manipulating the control member 60 will be detected by the user input sensor 84. The controller 87 may be configured to interpret the signals received from the user input sensor 84 to generate a command to be output to one of the peripheral devices 30. For example, if the wearer manipulates the control member 60 in one direction, such a signal may indicate that the ventilation system output should be increased. Alternatively, if the wearer manipulates the control member 60 in the opposite direction, it may indicate that the ventilation system output should be decreased. For example, wherein the control member 60 is configured as a rotational knob, the controller 87 may be configured to increase the power output provided by the power source to the fan when the control member 60 is rotated clockwise and to decrease the power output provided by the power source to the fan when the control member 60 is rotated counter-clockwise, or vice versa.

In order to determine the directionality that the control member 60 is being manipulated by the wearer, the control mount 70 may comprise multiple sets of adjacent first lens portions 72A and second lens portions 72B positioned at known locations on the control mount 70 relative to one another and configured to allow the one or more encoder elements 64 of the control member 60 to pass between the sets of adjacent first lens portions 72A and second lens portions 72B. For example, as illustrated in FIG. 5A-5B, the control mount 70 comprises a first set of adjacent first lens portions 72A and second lens portions 72B and a second set of adjacent first lens portions 72A and second lens portions 72B. The first set of adjacent first lens portions 72A and second lens portions 72B and the second set of adjacent first lens portions 72A and second lens portions 72B may be oriented at angle of less than 180 degrees relative to one another when measured from the center of the control mount 70. The controller 87 may be configured to determine the direction that the control member 60 was manipulated based on a comparison of the signals received from user input sensor 84 associated with each set of adjacent first lens portions 72A and second lens portions 72B using the known angle between the various pairs of lenses and the distance between each of the plurality of encoder elements 64.

Alternatively, the direction that the control member 60 was manipulated may be determined using an encoder element(s) 64 that is partially constructed of an opaque material and partially constructed of a translucent material. For example, a first edge of the encoder element 64 may be constructed of the opaque material and a second edge of the encoder element 64 may be constructed of the translucent material. In this embodiment, when the wearer manipulates the control member 60 in one direction, the translucent edge of the encoder element 64 may initially pass between the first lens portion 72A and second lens portion 72B, with the opaque edge to follow. Alternatively, when the control member 60 is manipulated in the opposite direction, the opaque edge of the encoder element 64 may initially pass between the first lens portion 72A and second lens portion 72B, with the translucent edge to follow. The controller 87 may be configured to determine the direction the control member 60 was manipulated based on the known configuration of the encoder element 64 and the pattern of distorted versus disrupted light signals received by the user input sensor 84.

Referring to FIG. 6A-7B, two exemplary embodiments of linear control members 160, 260 and control mounts 170, 270 are illustrated. In a first embodiment, the linear control member 160 and control mount 170 may be configured to operate similar to the control member 60 described above. The control member 160 made be configured to slidingly engage the control mount 170. The control member 160 may include an attachment member 162 configured to engage an environment side coupler 163 of the control mount 170. The attachment member 162 and environment side coupler may include a track, rail, or similar sliding mechanism. The control member 160 may further include one or more encoder elements 164 spaced along the length of the control member 160. The control mount 170 may include a single set of first lens portions 172A and second lens portions 172B, or a plurality of sets of first lens portions 172A and second lens portions 172B, with each set of adjacent first lens portions 172A and second lens portions 172B spaced apart to allow the encoder element(s) 164 to pass between each set of adjacent first lens portions 172A and second lens portions 172B.

Figure 6A:
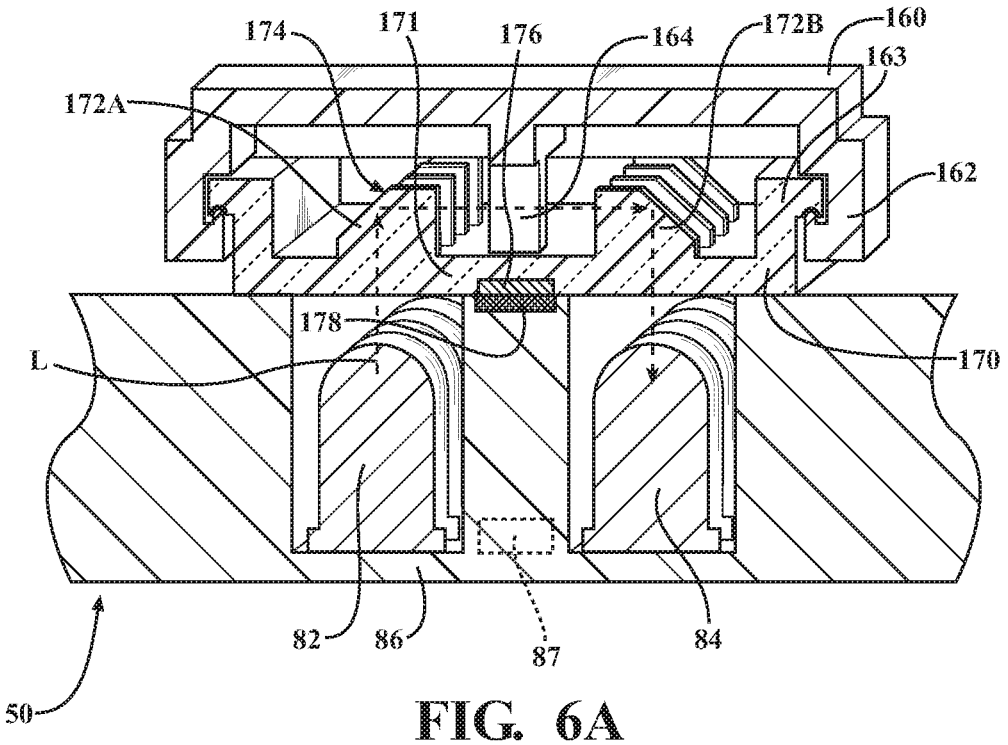
FIG. 6A is a sectional view of a second embodiment of a control mount and control member of the protective apparel system of FIG. 1.
Figure 6B:
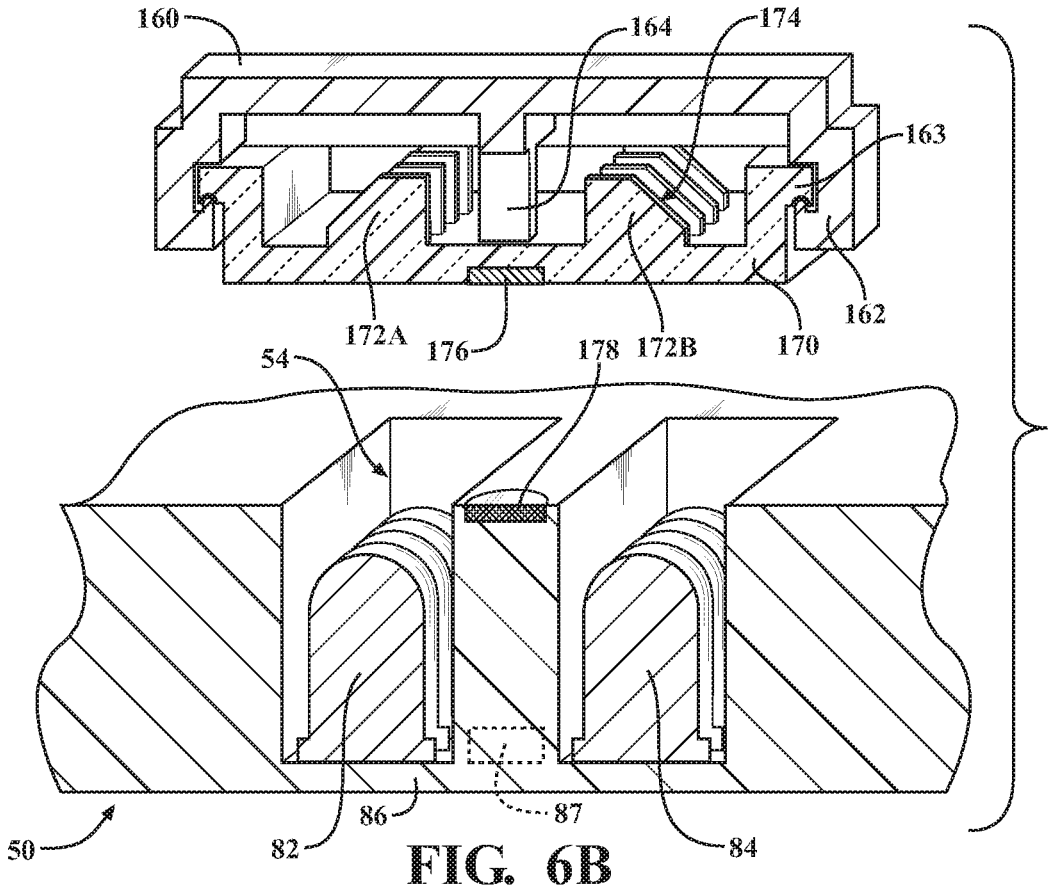
FIG. 6B is a partially exploded sectional view of the second embodiment of the control mount and control member of FIG. 6A.

As illustrated in FIGS. 6A-6B, the control member 160 comprises a single encoder element 164 configured to pass between a plurality of sets of first lens portions 172A and second lens portions 172B when the control member 160 is manipulated by the wearer. Similar to as described above, the control housing 50 may include on or more emitters 82 and/or user input sensors 84 aligned with the each set of first lens portions 172A and second lens portions 172B, respectively. The controller 87 may be configured to output operational commands to the emitter 82, as well as configured to receive a signal from the user input sensor 84 related to a characteristic of the signal detected by the user input sensor 84. When the encoder element 164 passes between a set of adjacent first lens portions 172A and second lens portions 172B, the signal transmitted by the emitter 82 may be disrupted and/or distorted, and the user input sensor 84 may be configured to detect the changes disruption or distortion of the signal.

In operation, when the single encoder element 164 passes between a first lens portion 172A and second lens portion 172B, the signal from the emitter 82 may be disrupted or distorted as the signal is transferred between the first lens portion 172A and the second lens portion 172B. The user input sensor 84 may be configured to detect the disruption and/or distortion of the signal from the emitter 82. For example, the emitter 82 may produce a light that is transferred through the first lens portion 172A and an operative surface redirects the light to the second lens portion 172B, which directs the light to the user input sensor 84. The encoder element 164 may be configured to disrupt or distort the transfer of light between the first lens portion 172A and second lens portion 172B when the control member 160 is manipulated by the wearer. The controller 87, being connected to each of the plurality of user input sensors 84 may be configured to identify the location of the control member 160 based on the user input sensor 84 that detects the disruption or distortion of light. The controller 87 may be configured to send operational commands to the peripheral devices 30 of the surgical helmet 20 based on the signal received from the user input sensor 84. For example, the controller 87 may be configured to turn off the peripheral device when the encoder element 164 is positioned between a first set of lens portions 172A/172B. The controller may be further configured to increase the power output to the peripheral device 30 as the encoder element 164 moves to a second set of lens portions 172A/172B, a third set of lens portions 172A/172B, and so on, until the encoder element 164 reaches a final set of lens portions 172A/172B.

While not illustrated, it should be understood that it is contemplated that that the control mount 170 may be configured to have a single set of adjacent first lens portions 172A and second lens portions 172B, and the control member 160 may comprise a plurality of the encoder elements 164 spaced along the length of the control member 160. In this embodiment, encoder element 164 may be constructed of a translucent material, an opaque material, or some combination thereof. The user input sensor 84 may be configured to detect a pattern based on the change in intensity or the presence and absence of a signal from the emitter 82 when the plurality of encoder elements 164 pass between the first lens portion 172A and the second lens portion 172B, indicating the wearer is manipulating the control member 160. The controller 87 may be configured to send operational commands to the peripheral devices 30 of the surgical helmet 20 based on the signal received from the user input sensor 84.

Figure 7A:
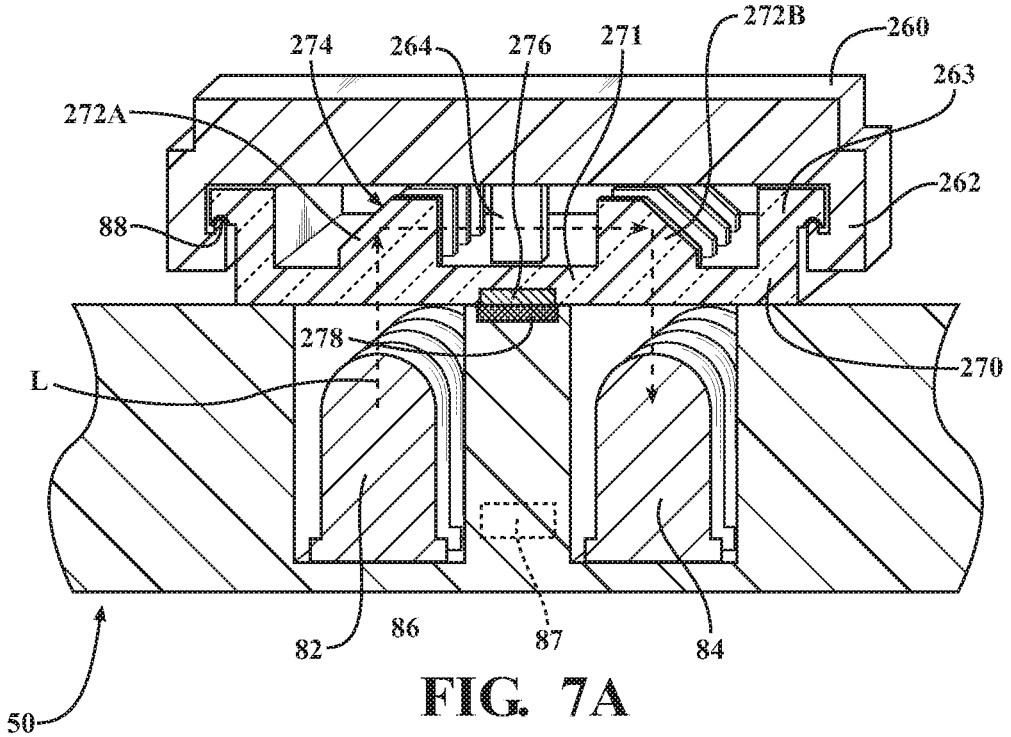
FIG. 7A is a sectional view of a third embodiment of the control mount and control member of FIG. 6A further including a detent.
Figure 7B:
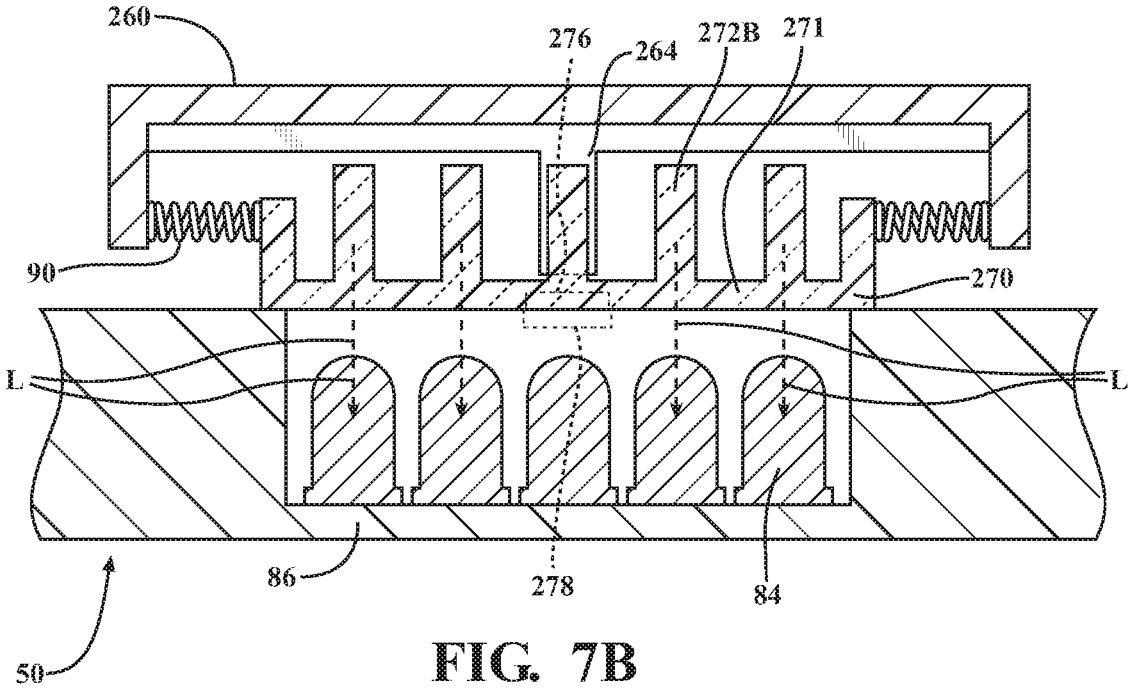
FIG. 7B is a sectional view of a fourth embodiment of the control mount and control member of FIG. 6A further including a biasing member.

Referring to FIGS. 7A-7B, a third exemplary embodiment of a linear control member 260 is illustrated. Similar to the first embodiment of the linear control member 160, the second embodiment of the linear control member 260 may be configured to slidingly engage the control mount 270. The control member 260 may include an attachment member 262 configured to engage an environment side coupler 263 of the control mount 270. The attachment member 262 and environment side coupler may include a track, rail, or similar sliding mechanism. The control member 260 may further include one or more encoder elements 264 spaced along the length of the control member 260. The control mount 270 may include a single set of first lens portions 272A and second lens portions 272B, or a plurality of sets of first lens portions 272A and second lens portions 272B, with each set of adjacent first lens portions 272A and second lens portions 272B spaced apart to allow the encoder element(s) 264 to pass between each set of adjacent first lens portions 272A and second lens portions 272B. However, the second linear embodiment of the control member 260, as illustrated in FIGS. 7A-7B may further comprise one or more detents 88 or other suitable feature to provide tactile feedback to the wearer to allow them to determine the relative position of the control member 260 and to provide inadvertent movement of the control member 260 relative to the control mount 270. It is contemplated that the other embodiments of the control members, such as the rotatable control members, may have a detent feature incorporated in a similar fashion such that the control member provides tactile feedback to the wearer during movement of the control member.

The second linear embodiment may further include a biasing member 90 as part of the attachment member 262 and the environment side coupler 263 for attaching the control member 260 to the control mount 270. For example, the attachment member 262 and the environment side coupler 263 may be configured as a sliding rail connection, wherein the rail connection comprises a detent 88 positioned along the rail. The detent 88 may comprise a protrusion on the attachment member 262 configured to engage a plurality of recesses in the environment side coupler 263. The detent 88 may be configured to temporarily or releasably hold the control member 260 in a specific location relative to the control mount 270. For example, in the embodiment illustrated in FIG. 7A, the control member 260 comprises a single encoder element 264 configured to pass between a plurality of sets of first lens portions 272A and second lens portions 272B when the control member 60 is manipulated by the wearer. The detent 88 may be configured to releasably secure the control member 260 at each point along the control mount 270 corresponding to a control member 260 position where the encoder element 264 would be positioned between a set of first lens portions 272A and second lens portions 272B.

Referring to FIG. 7B, the linear control member 260 may be configured to comprise the biasing member 90. The biasing member 90 may comprise a spring or similar member configured to actively assist the positioning of the control member 260 relative to the control mount 270. As illustrated in FIG. 7B, a side view of the control mount 270 and control member 260 show the biasing member 90 comprising a pair of springs 90, each attached at opposing ends of the control member 260 and control mount 270. As described above, the control member 260 may be slidingly engaged with the control mount 270 via the environment side coupler 263 and the attachment member 262. Similar to as described above the control member 260 may comprise one or more encoder elements 264 spaced along the length of the control member 260. The control mount 270 may comprise an adjacent set of first lens portions 272A and second lens portions 272B, or a plurality of adjacent sets of first lens portions 272A and second lens portions 272B, with each set of adjacent first lens portions 272A and second lens portions 272B spaced apart to allow the encoder element(s) 264 to pass between each set of adjacent first lens portions 272A and second lens portions 272B. The biasing members 90 may be configured to return the control member 260 to its original position relative to the control mount 270 after the wearer has manipulated the control member 260. For example, if the wearer slides the control member 260 left, right, up, or down, the biasing member 90 will return the control member 260 to its original position once the wearer stops manipulating the control member 260. In operation, the controller 87, being connected to each of the plurality of user input sensors 84 may be configured to identify the location of the control member 260 based on the user input sensor 84 that, in one embodiment, detects the disruption or distortion of light. The controller 87 may be configured to send operational commands to the peripheral devices 30 of the surgical helmet 20 based on the signal received from the user input sensor 84. For example, if the wearer were to manipulate the control member 260 to the right, the controller 87 be configured to send operational commands to the peripheral device 30, such as the ventilation assembly, to increase the power output. After the wearer has finished manipulating the control member 260, the biasing member 90 may return the control member 260 to its original position. If the wearer were to manipulate the control member 260 to the right again, the controller 87 may be configured to send operational commands to the peripheral device 30 to increase the power output further. However, if the wearer were to manipulate the control member 260 to the left, the controller 87 may be configured to send operational commands to the peripheral device 30 to decrease the power output. It should be appreciated the rotational embodiments of the control member may also include similar biasing members.

Referring to FIGS. 8A-10C, various exemplary embodiments of control members comprising encoder elements including an operative surface are illustrated. More specifically, exemplary embodiments of a control member 360/460 comprising an encoder element 364/464 with an operative surface 374/474 is illustrated. The control member 360/460 may include an attachment member 362/462 configured to engage an environment side coupler 363 of the control mount 370. The control member 360/460 may comprise one or more encoder elements 364/464 radially spaced about the control member 360/460. The encoder element 364/464 may comprise an operative surface 374/474 configured to optimally direct, reflect and/or focus light. The operative surface 374/474 may be configured in a shape to optimally direct, reflect, and/or focus light. Suitable shapes may include, but are not limited to, curved, angled, beveled, or arc-shaped. The operative surface 374/474 may also be finished or coated to improve its ability to direct, reflect, and/or focus light. Because the encoder elements 364, 464 include the operative surfaces 374, 474, the lens portions of the control mount need not direct light in a radial direction, but rather may direct light primarily in the axial direction, i.e., in a direction that is parallel to the longitudinal axis of the control member. This is because the operative surfaces of the encoder elements serve to redirect the axially-directed light from one lens portion back to the other lens portion. In the earlier embodiments, the lens portions include the operative surfaces, and hence those lens portions direct light primarily in a radial direction and the encoder elements do not redirect light in a different direction.

The control mount 370 may include a single set of first lens portions 372A and second lens portions 372B, or a plurality of sets of first lens portions 372A and second lens portions 372B, configured to transfer light through the barrier. When the control member 360/460 is manipulated by the wearer, the plurality of encoder elements 364/464 will go in and out of alignment with the sets of first lens portions 372A and second lens portions 372B. When an encoder element is aligned with the sets of first lens portions 372A and second lens portions 372B, the operative surface 374/474 may be configured to receive light from the emitter 82 and redirect the light to the user input sensor 84. When an encoder element 364/464 is not aligned with the set(s) of first lens portions 372A and second lens portions 372B, the user input sensor 84 will not receive the light. The controller 87, being connected to user input sensor 84 may be configured to generate an operation command for a peripheral device 30 based on the pattern of light signals detected by the user input sensor 84. The controller 87 may be configured to send operational commands to the peripheral devices 30 of the surgical helmet 20 based on the signal received from the user input sensor 84.

Figure 8A:
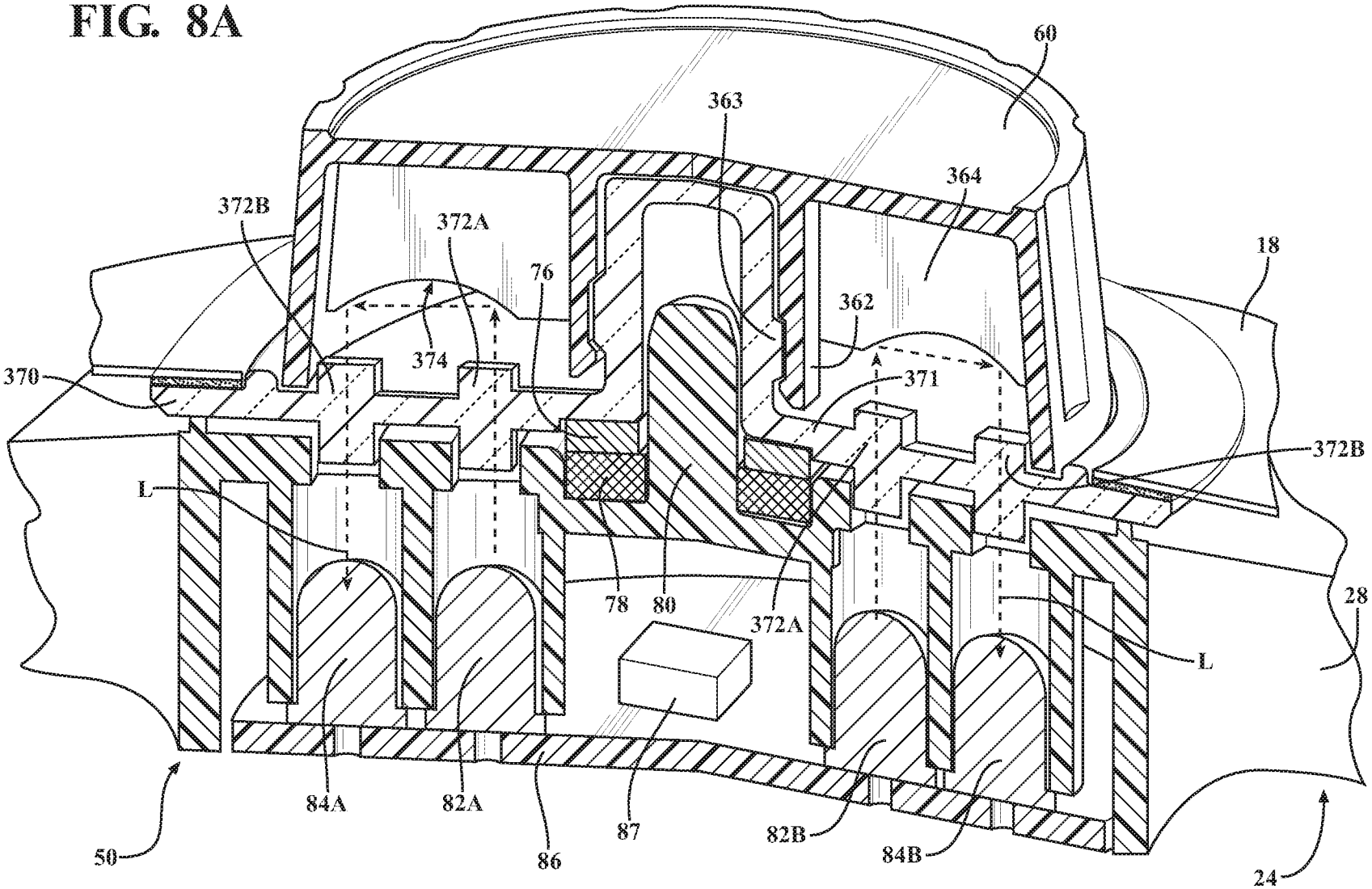
FIG. 8A is a sectional view of a fifth embodiment of the control mount and control member of the protective apparel system of FIG. 1.
Figure 8B:
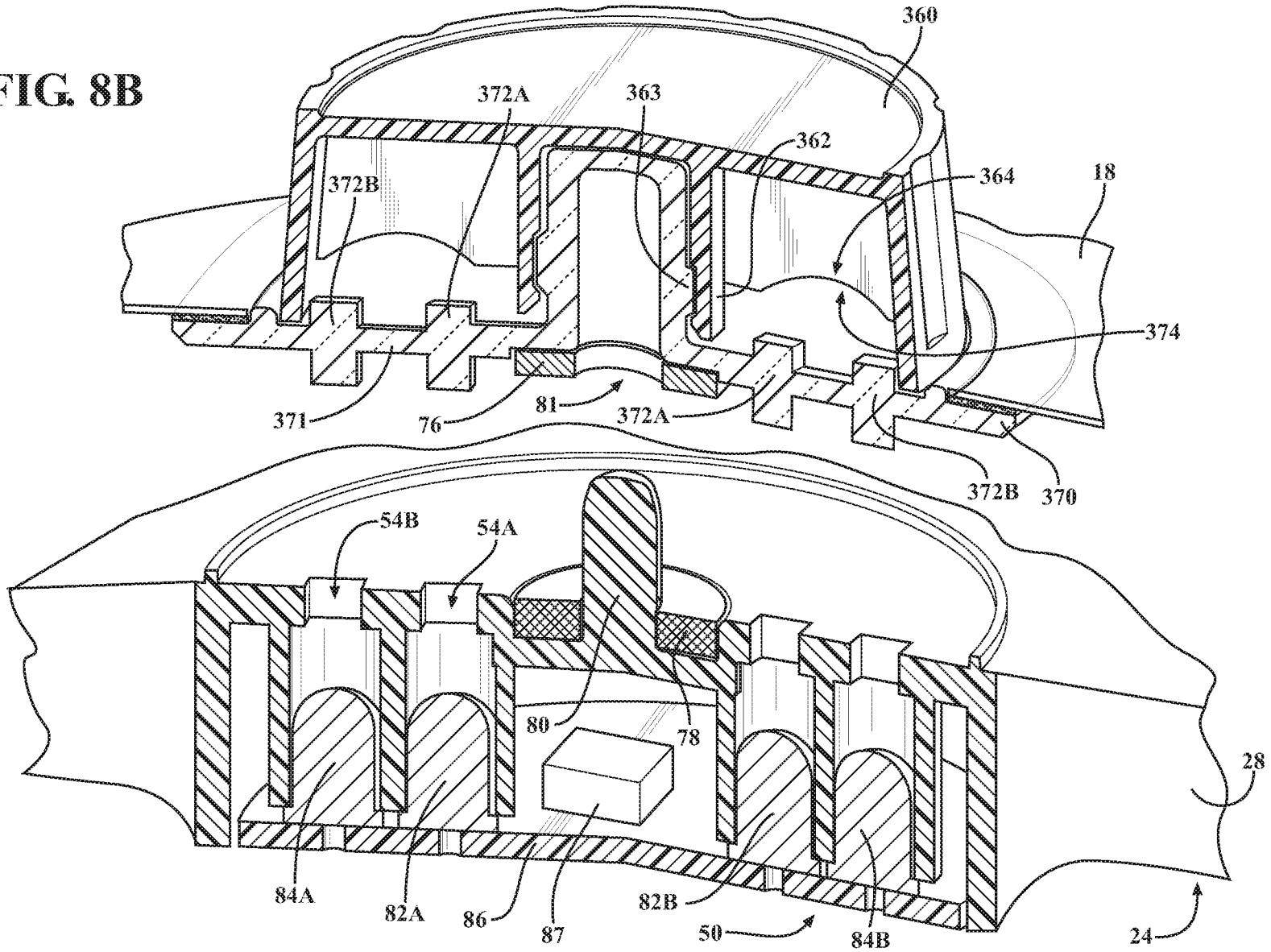
FIG. 8B is a partially exploded sectional view of the fifth embodiment of the control mount and control member of FIG. 8A.
Figure 8C:
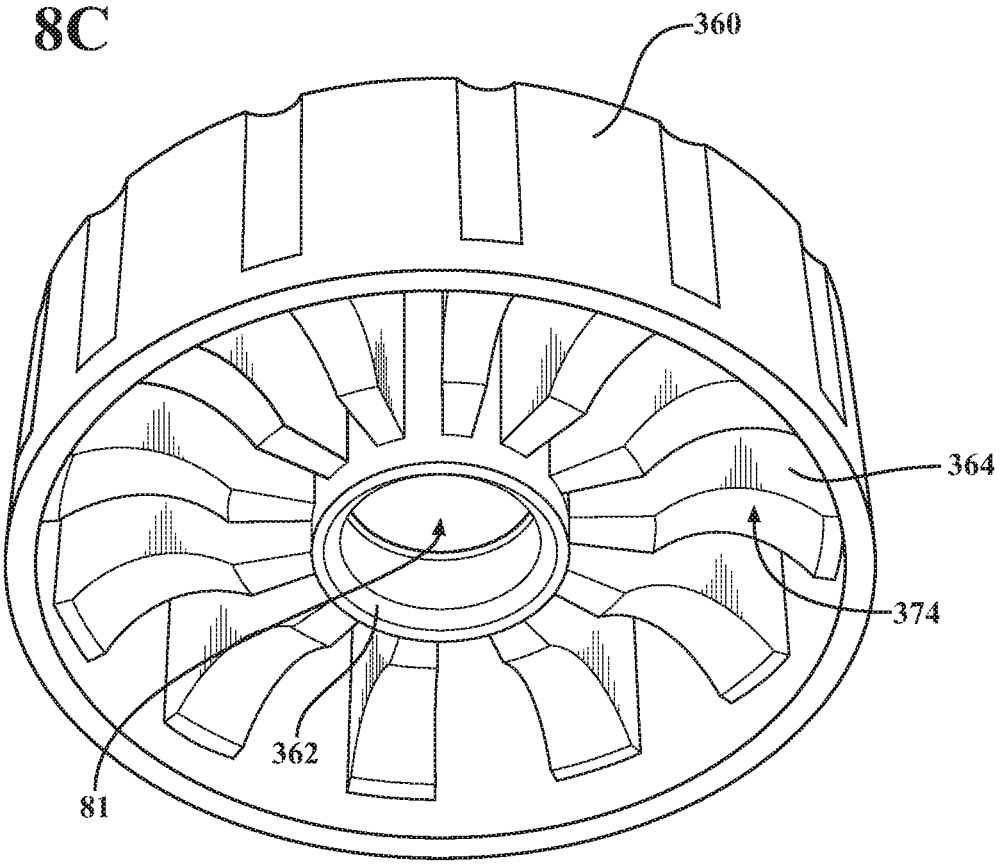
FIG. 8C is a perspective view of the fifth embodiment of the control member of FIG. 8A.

As illustrated in FIGS. 8A-8C, an exemplary embodiment of a control member 360 comprises a plurality of encoder element 364 radially spaced about the control member 360. Each encoder element 374 is configured to comprise an arc-shaped operative surface 374. In operation, as the control member 360 is manipulated by the wearer, the encoder elements 364 will go in and out of alignment with the sets of first lens portions 372A and second lens portions 372B. When an encoder element 364 is aligned with the sets of first lens portions 372A and second lens portions 372B, the operative surface 374 of the aligned encoder element 374 will receive light from the emitter 82. The operative surface 374 will redirect the light to the user input sensor 84. When the encoder element 364 goes out of alignment the transfer of light from the emitter 82 to the user input sensor 84 will be disrupted without the operative surface 374 of the encoder element 364 to redirect the light from the emitter 82 to the user input sensor 84. The user input sensor 84 may be on figured to output a signal to the controller 87 based on the pattern of light signals detected. The controller 87, being connected to user input sensor 84 may be configured to generate an operation command for a peripheral device 30 based on the pattern of light signals detected by the user input sensor 84. The controller 87 may be operatively connected to one or more peripheral devices 30 configured to send operational commands to the peripheral devices 30 of the surgical helmet 20 based on the signal received from the user input sensor 84.

Figure 8D:
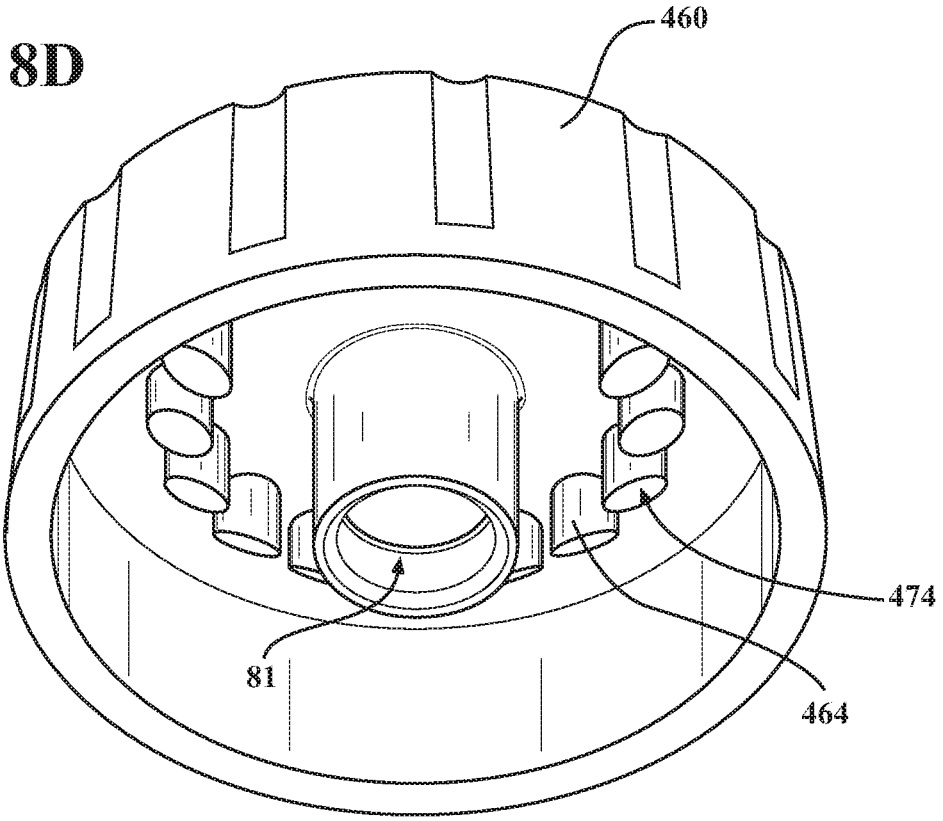
FIG. 8D is a perspective view of an alternate design of the fifth embodiment of the control member of FIG. 8A.

Referring to FIG. 8D, an alternative embodiment of a control member 460 comprising a plurality of encoder elements 464 including operative surfaces 474 is illustrated. Each encoder element 464 may comprise an operative surface 474 configured to optimally direct, reflect and/or focus light. The plurality of encoder elements 464 are radially spaced about the control member 460. Each encoder element 374 is configured to comprise a sloped operative surface 474 that may be generally aligned with the lens portion 272B that is aligned with the emitter/light source. Similar to as described above, in operation, as the control member 460 is manipulated by the wearer, the encoder elements 464 will go in and out of alignment with the sets of first lens portions 372A and second lens portions 372B. When an encoder element 464 is aligned with the sets of first lens portions 372A and second lens portions 372B, the operative surface 474 of the aligned encoder element 474 will receive light from the emitter 82. The operative surface 474 will redirect the light to the user input sensor 84. When the encoder element 464 goes out of alignment with the first lens portions 372A and second lens portions 372B, the transfer of light from the emitter 82 to the user input sensor 84 will be disrupted. The user input sensor 84 may be configured to output a signal to the controller 87 based on the pattern of light signals detected. The controller 87, being connected to user input sensor 84, may be configured to generate an operation command for a peripheral device 30 based on the pattern of light signals detected by the user input sensor 84. The controller 87 may be operatively connected to one or more peripheral devices 30 configured to send operational commands to the peripheral devices 30 of the surgical helmet 20 based on the signal received from the user input sensor 84.

In operation of the embodiment disclosed in FIGS. 8A-8D, the control mount 370 may include a one or more sets of first lens portions 372A and second lens portions 372B configured to transfer light through the barrier. The control housing 50 of the surgical helmet 20 may further comprise pairs of emitters 82 and user input sensors 84 aligned with the lens portions 372A/372B, wherein the emitter 82 is configured to emit light through the first lens portion 372A and the user input sensor 84 is configured to detect the presence and/or absence of light passing through the second lens portion 372B. The operative surface 374 of the encoder element 364, may become aligned with a set of lens portions 372A/372B when the wearer manipulates the control member 360. When the encoder element(s) 364 become aligned with the set of lens portions 372A/372B, the operative surface 374 of the encoder element 364 may be configured to receive light through the first lens portion 372A from the emitter 82 of the control housing 50 and redirect and/or reflect the light back through the second lens portion 372B to the user input sensor 84 of the control housing 50. When aligned, the user input sensor 84 will detect the presence of, the absence of, and/or any changes in intensity of the light. When the control member 360 is further manipulated, and the operative surface 374 of the encoder element 364 will move out of alignment with the lens portions 372A/372B, and the light from the emitter 82 will be disrupted from reaching the user input sensor 84. The user input sensor 84 will detect the absence of light. Based on the pattern of light detected by the user input sensor 84, the user input sensor 84 may be configured to output a signal to the controller 87 indicating manipulation of the control member 360 by the wearer. The controller 87 may be configured to adjust the power output by the battery to a peripheral device 30, such as the ventilation assembly described above. Based on direction the control member 360 is manipulated, the controller 87 may be configured to generate the appropriate command to the peripheral device 30. Similar to the configurations described above, the direction that the control member 360 is manipulated may be determined by having multiple sets of lens portions 72A/72B with complementary pairs of emitters 82 and user input sensors 84. The controller 87 may be configured to determine the direction the control member 360 is manipulated based on the pattern of the signals received from two or more user input sensors 84 based on the known location of the user input sensors 84 relative to one another and a known spacing of the plurality of encoder elements 364 of the control member 360.

Figure 9A:
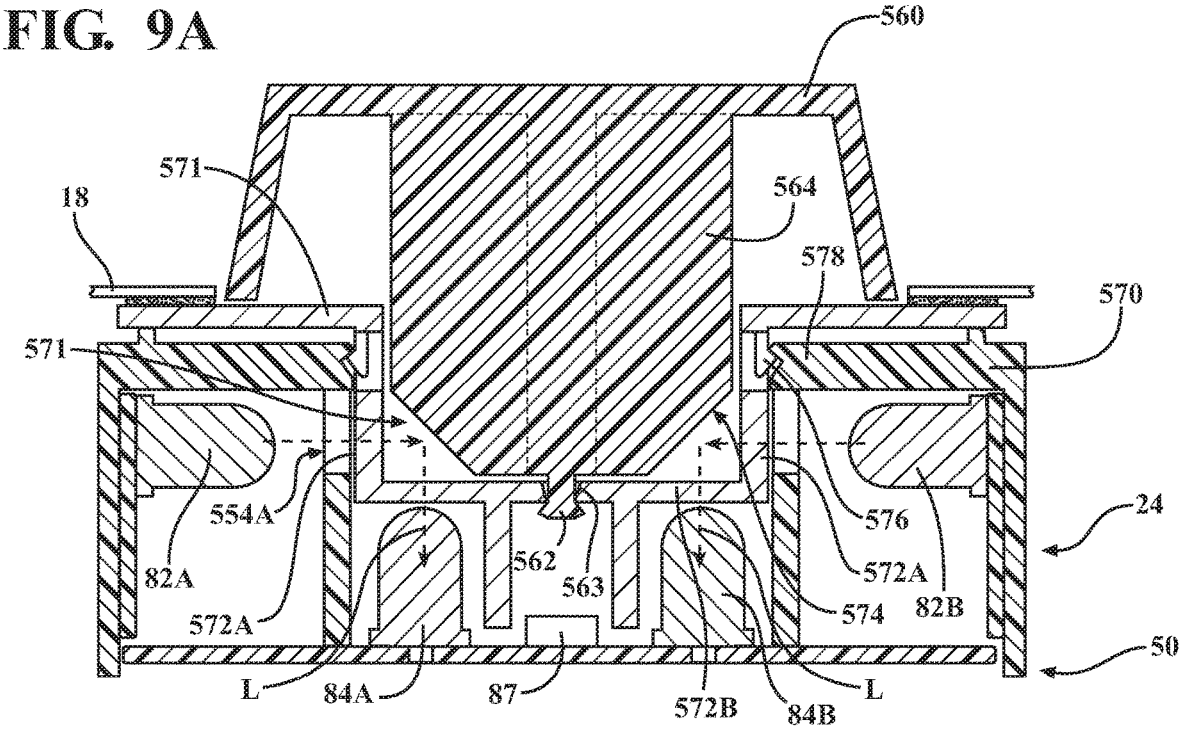
FIG. 9A is a sectional view of a sixth embodiment of the control mount and control member of the protective apparel system of FIG. 1.
Figure 9B:
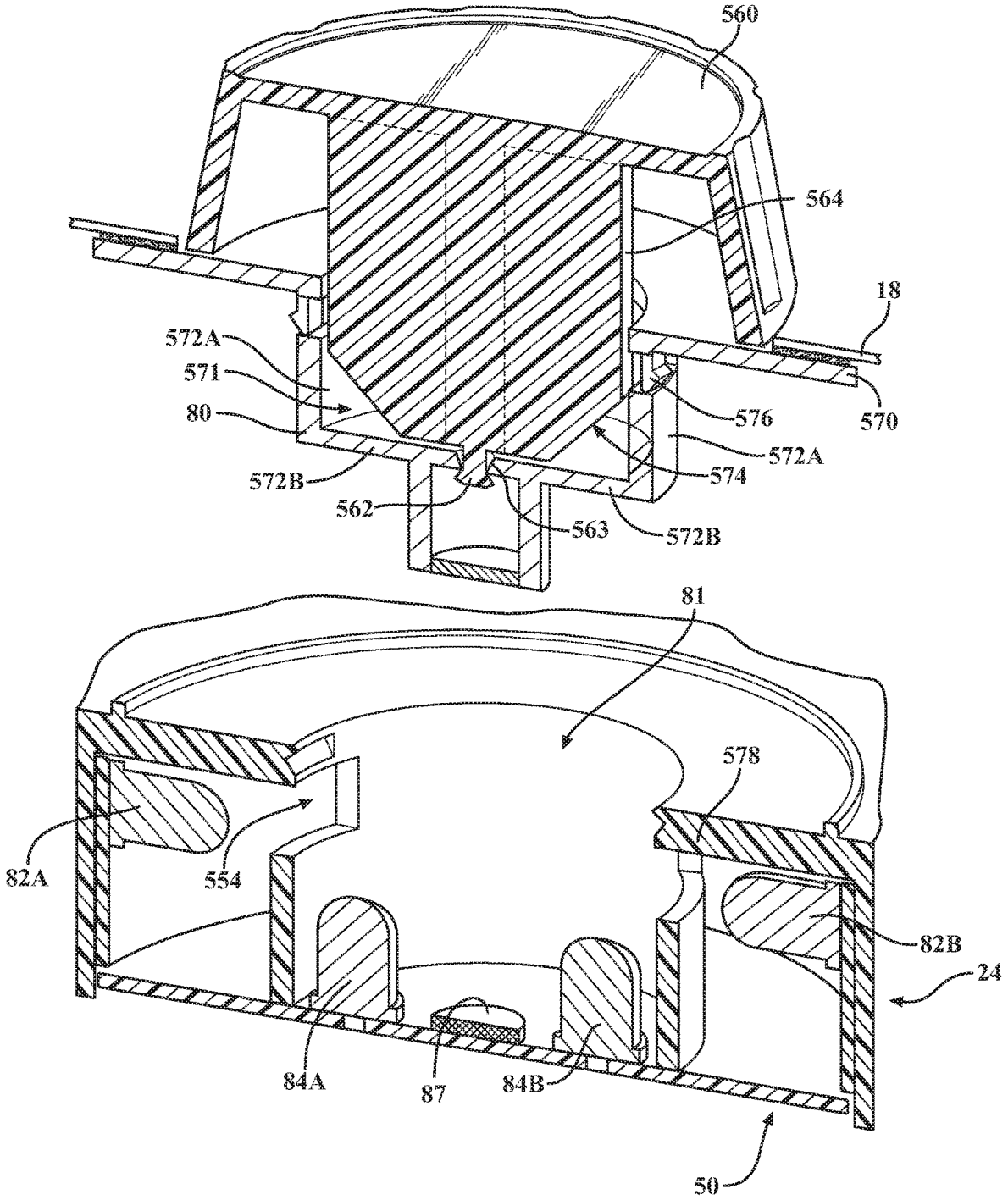
FIG. 9B is a partially exploded sectional view of the sixth embodiment of the control mount and control member of FIG. 9A.
Figure 9C:
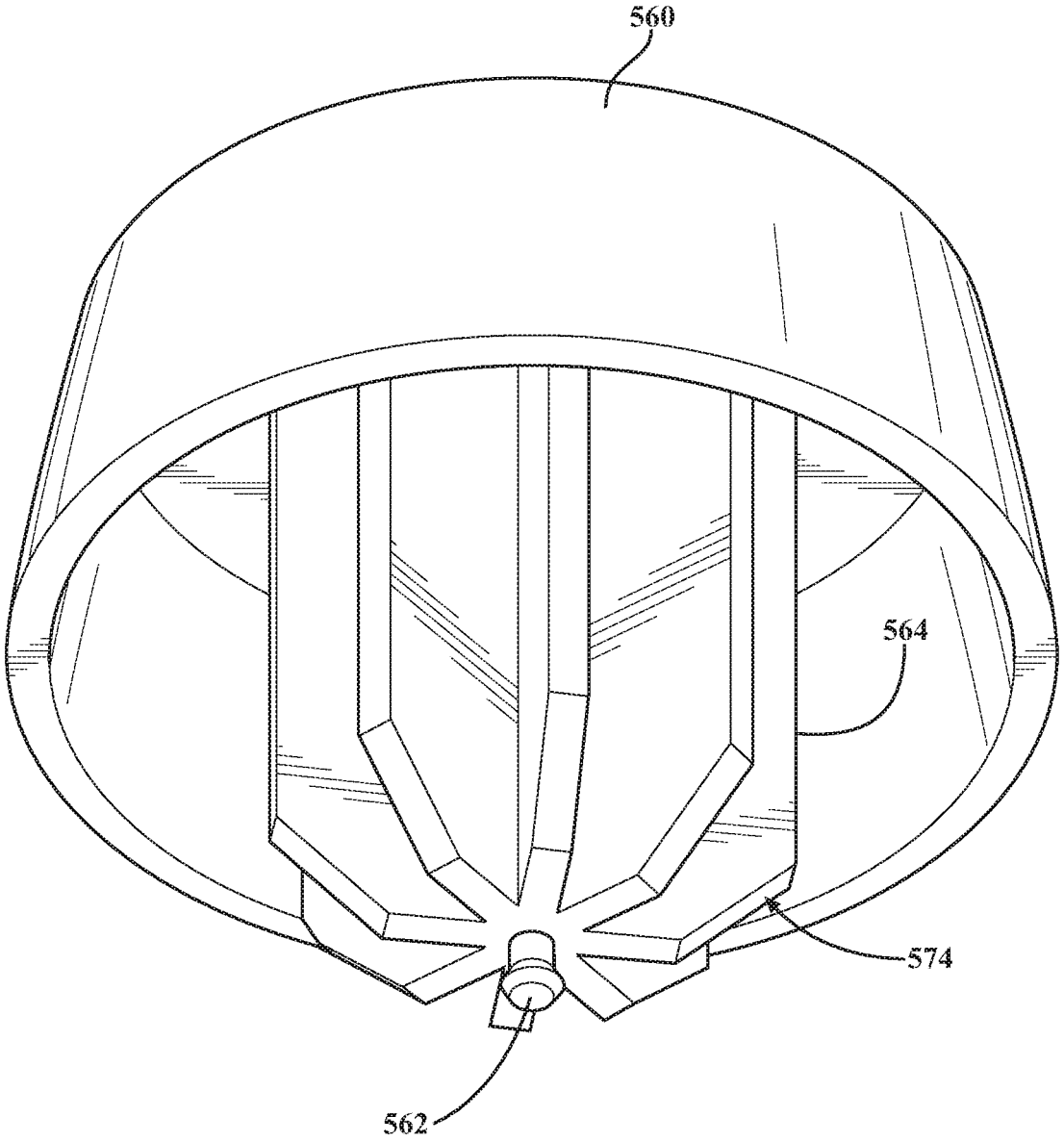
FIG. 9C is a perspective view of the control member of FIG. 9A.

Referring to FIGS. 9A-9C, an exemplary embodiment of a protruded control member 560 with a recessed control mount 570 is illustrated. The control member 560 comprises a plurality of encoder elements 564 extending radially from the center of the control member 560. The encoder elements may further be configured to protrude outward from the control member 560 towards the control mount 570. Proximate the end of each encoder element 564, opposite the control member 560, the encoder element 564 may comprise an operative surface 574. The operative surface 574 may be configured to optimally direct, reflect and/or focus light. The operative surface 574 may be configured in a shape to optimally direct, reflect, and/or focus light. Suitable shapes may include, but are not limited to, curved, angled, beveled, or arc-shaped. The operative surface 574 may also be finished or coated to improve its ability to direct, reflect, and/or focus light. Similar to as described above, the control member 560 may also comprise an attachment member 562 configured to operatively engage the environment side coupler 563 of the control mount 570 to attach the control member 560 to the control mount 570.

The control mount 570 may comprise a recess 571 configured to receive the plurality of encoder elements 564 protruding from the control member 560. This recess 571 may be disposed such that it extends into the environment side of the surgical garment 12. The control mount 570 may also include an alignment feature 580 configured to matingly engage an aperture 581 of the control housing 50. The control mount 570 may further comprise a wearer side coupler 576, similar to as described above, configured to engage the coupling device 578 of the control housing 50. The wearer side coupler 576 and the coupling device 578 may comprise complementary snap-fit features, friction-fit features, magnets, or similar releasable coupling devices.

Similar to as described above, the control mount 570 may comprise one or more lens portions 572A, 572B. The lens portions 572A, 572B may be constructed of a transparent material, such as glass or polycarbonate, and configured to allow the transmission of light through the surgical garment 12. As illustrated in FIGS. 9A-9C, the operative surface 574 is positioned adjacent the first lens portion 572A and the second lens portion 572B. The operative surface 574 is angled and configured to redirect light that passes through the first lens portion 572A from the emitter 82 through the second lens portion 572B to the user input sensor 84 when and operative surface 574 is aligned with the first lens portion 572A and second lens portion 572B. The operative surface 574 of the encoder element 564 may go in and out of alignment with the first lens portion 572A and second lens portion 572B when the control member 560 is manipulated by the wearer.

As illustrated in FIGS. 9A-9C, an exemplary embodiment of a control member 560 comprises a plurality of encoder element 564 radially spaced about the control member 560. Each encoder element 564 is configured to comprise an angled operative surface 574. In operation, as the control member 560 is manipulated by the wearer, the encoder elements 564 will go in and out of alignment with the sets of first lens portions 572A and second lens portions 572B. When an encoder element 564 is aligned with the sets of first lens portions 572A and second lens portions 572B, the operative surface 574 of the aligned encoder element 564 will receive light from the emitter 82. The operative surface 574 will redirect the light to the user input sensor 84. When the encoder element 564 goes out of alignment, the transfer of light from the emitter 82 to the user input sensor 84 will be disrupted. The user input sensor 84 may be configured to output a signal to the controller 87 based on the pattern of light signals detected. The controller 87, being connected to user input sensor 84 may be configured to generate an operation command for a peripheral device 30 based on the pattern of light signals detected by the user input sensor 84. The controller 87 may be operatively connected to one or more peripheral devices 30 configured to send operational commands to the peripheral devices 30 of the surgical helmet 20 based on the signal received from the user input sensor 84.

Figure 10A:
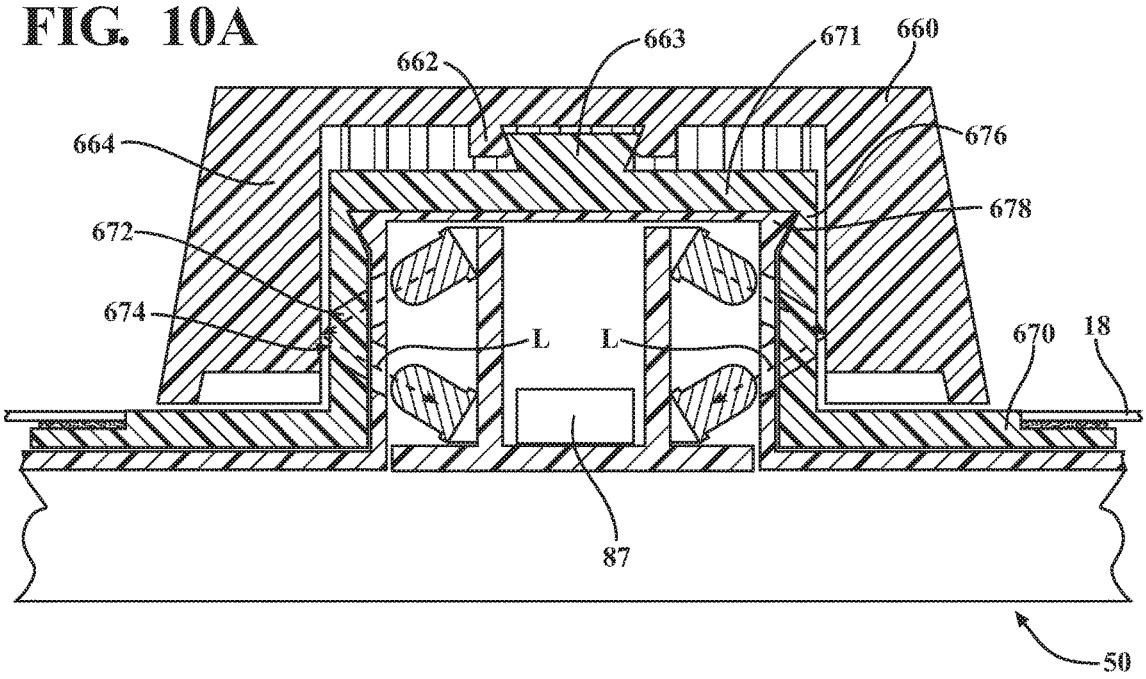
FIG. 10A is a sectional view of a seventh embodiment of a control mount and recessed control member of the protective apparel system of FIG. 1.
Figure 10B:
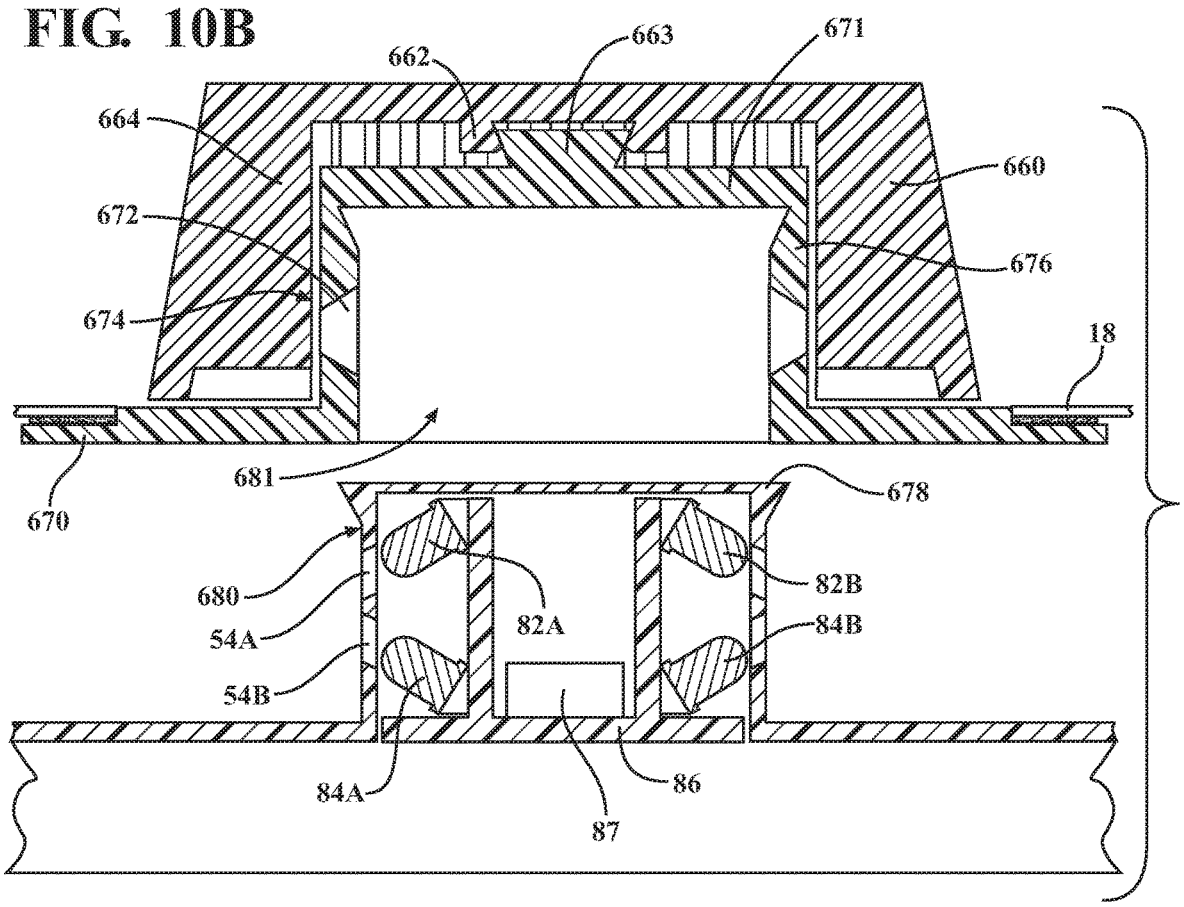
FIG. 10B is a partially exploded sectional view of the seventh embodiment of the control mount and control member of FIG. 10A.
Figure 10C:
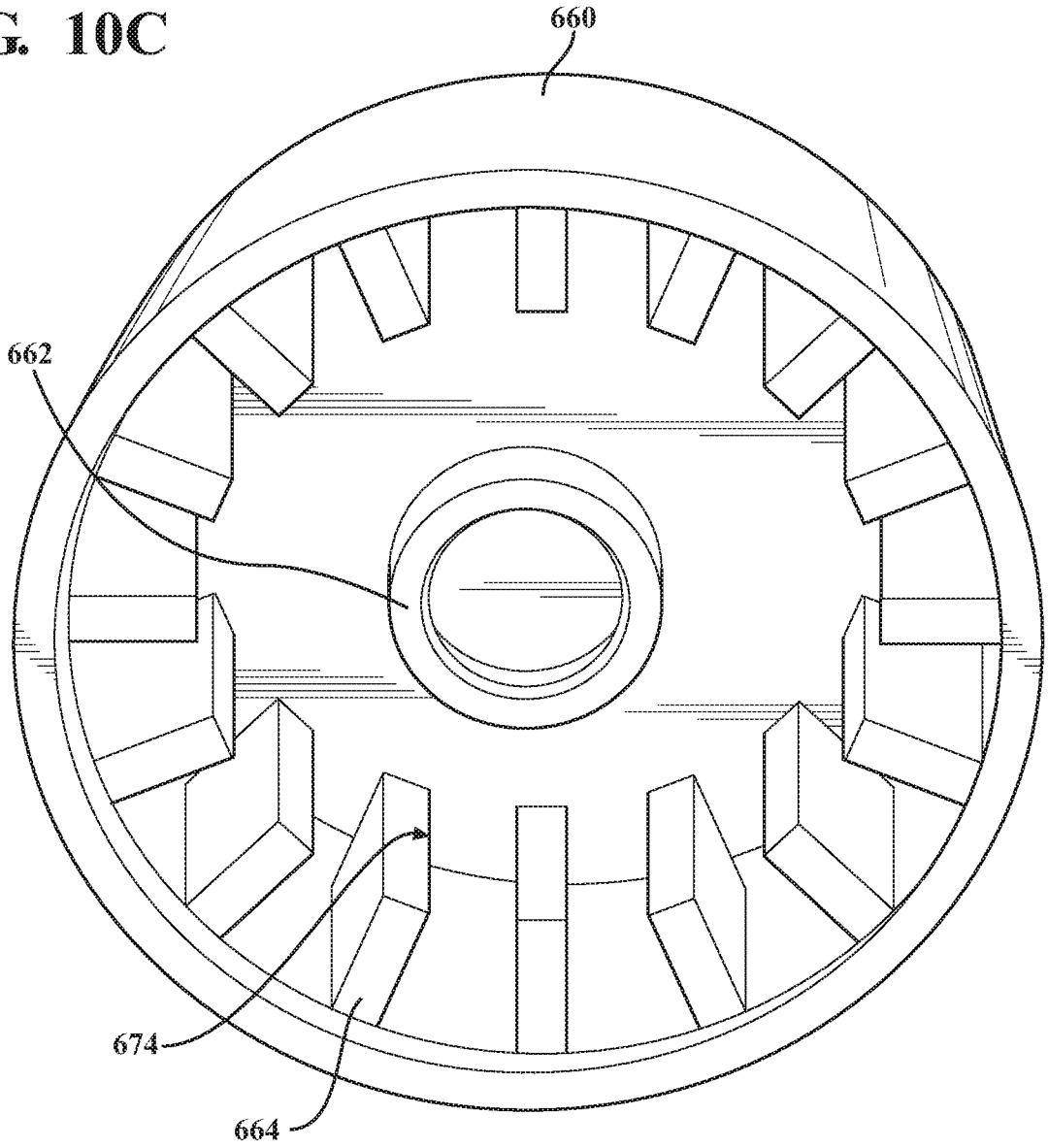
FIG. 10C is a perspective view of the control member of FIG. 10A.

Referring to FIGS. 10A-10C, an example embodiment of the recessed control member 660 with a protruded control mount 670 is illustrated. The control member 660 comprises a plurality of encoder elements 664 arranged radially at the periphery of the control member 660. The encoder elements 664 may further be configured to protrude inward from the periphery of the control member 660 towards the control mount 670 when the control member 660 is coupled to the control mount 670. The control mount 670 may include an alignment feature 680 configured to extend into a recess 681 of the control member 660. An interior surface of each encoder element 664, configured to be positioned adjacent the alignment feature 680 of the control mount 670, may comprise an operative surface 674. Similar to as described above, the control member 660 may also comprise an attachment member 662 configured to operatively engage the environment side coupler 663 of the control mount 670 to attach the control member 660 to the control mount 670.

The control mount 670 may further comprise a wearer side coupler 676, similar to as described above, configured to engage the coupling device 678 of the control housing 50. The wearer side coupler 676 and the coupling device 678 may comprise complementary snap-fit features, friction-fit features, magnets, or similar releasable coupling devices.

Similar to as described above, the control mount 670 may comprise one or more lens portions 672A, 672B. The first lens portion 672A and the second lens portion 672B may be adjacent with the operative surface 674 of the encoder element 664 when the control mount 670 is attached to the control housing 50.

As illustrated in FIGS. 10A-10C, an exemplary embodiment of a control member 660 comprises a plurality of encoder element 664 radially spaced about periphery of the control member 660. Each encoder element 664 is configured to comprise a flat operative surface 674. In operation, as the control member 660 is manipulated by the wearer, the encoder elements 664 will go in and out of alignment with the sets of first lens portions 672A and second lens portions 672B. When an encoder element 664 is aligned with the sets of first lens portions 672A and second lens portions 672B, the operative surface 674 of the aligned encoder element 664 will receive light from the emitter 82. The operative surface 674 will redirect the light to the user input sensor 84. When the encoder element 664 goes out of alignment, the transfer of light from the emitter 82 to the user input sensor 84 will be disrupted. The user input sensor 84 may be configured to output a signal to the controller 87 for the peripheral device based on the pattern of light signals detected. The controller 87, being connected to user input sensor 84 may be configured to generate an operation command for a peripheral device 30 based on the pattern of light signals detected by the user input sensor 84. The controller 87 may be operatively connected to one or more peripheral devices 30 configured to send operational commands to the peripheral devices 30 of the surgical helmet 20 based on the signal received from the user input sensor 84.

Figure 11:
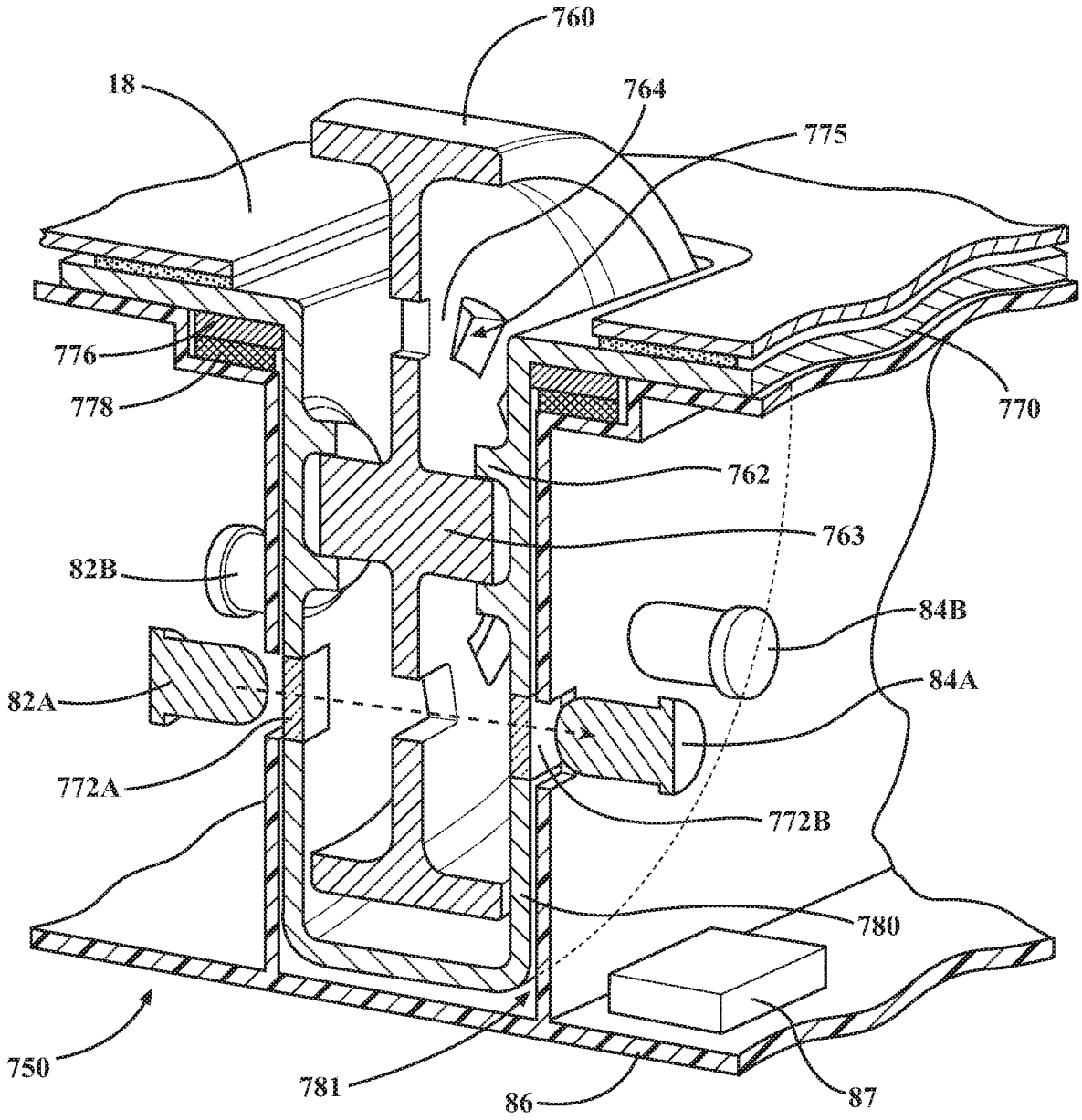
FIG. 11 is a sectional view of an eighth embodiment of the control mount and control member of the protective apparel system of FIG. 1.

Referring to FIG. 11, an example embodiment of the wheel control member 760 at least partially disposed within a recessed control mount 770 is illustrated. The control member 760 comprises a plurality of solid encoder elements 764 arranged circumferentially about the control member 760. The solid encoder elements 764 may comprise solid portions of the control member 760 configured disrupt or distort light as it passes from the emitter 82 to the user input sensor 84. Adjacent the solid encoder elements 764 are passive encoder elements 775 that may be configured to allow light to pass from the emitter 82 to the user input sensor 84 positioned on opposing sides of the control mount 770. The passive encoder elements 775 may comprise one or more apertures arranged circumferentially about the control member 760. Alternatively, the passive encoder elements 775 may comprise a translucent or transparent material configured to distort light or to optimally direct, reflect and/or focus light transmitted through the control member 760. While not illustrated in the Figures, it should be understood that it is contemplated that the emitter 82 and the user input sensor 84 may be configured to be on the same side of the control mount 770. In this embodiment, the passive encoder elements 775 may comprise a reflective material, such as a mirrored surface, configured to reflect the light from the emitter 82 back to the user input sensor 84 when the passive encoder elements 775 is aligned with the path of the light from the emitter 82. It should be understood that the emitter 82 and user input sensor 84 may need to be positioned at an angle relative to one another.

The control mount 770 may include a body portion 771 and a lens portion 772A, 772B. The body portion of the control mount 770 may further comprise an alignment feature 780 configured to extend into a recess 781 of the control housing 750. Similar to as described above, the control member 760 may also comprise an attachment member 762 configured to operatively engage the environment side coupler 763 of the control mount 770 to attach the control member 760 to the control mount 770.

The control mount 770 may further comprise a wearer side coupler 776, similar to as described above, configured to engage the coupling device 778 of the control housing 750. The wearer side coupler 776 and the coupling device 778 may comprise complementary snap-fit features, friction-fit features, magnets, or similar releasable coupling devices.

Similar to as described above, the control mount 770 may comprise one or more lens portions 772A, 772B. The first lens portion 772A and the second lens portion 772B may be positioned on opposing sides of the control mount 770. The first lens portion 772A may be positioned adjacent the emitter 82 and the second lens portion 772B may be positioned adjacent the user input sensor 84.

As illustrated in FIG. 11, an exemplary embodiment of a control member 760 comprises a plurality of solid encoder elements 764 circumferentially spaced about control member 760. Each solid encoder element 764 comprises an opaque portion configured to prevent the transfer of light from the emitter 82 to the user input sensor 84. Alternatively, the passive encoder elements 775 may be apertures of the control member 760 configured to allow light to pass through the control member 760. In operation, as illustrated in FIG. 11, as the control member 760 is manipulated by the wearer, the solid encoder elements 764 and passive encoder elements 775 will alternatingly go in and out of alignment with the sets of first lens portions 772A and second lens portions 772B. When passive encoder elements 775 are aligned with the sets of first lens portions 772A and second lens portions 772B, the passive encoder elements 775 will receive light from the emitter 82 through the first lens portion 772A. The passive encoder elements 775, will allow the light to pass through the control member 760 and be directed to the user input sensor 84 by the second lens portion 772B. Alternatively, when the solid encoder elements 764 are aligned with the sets of first lens portions 772A and second lens portions 772B, the transfer of light from the emitter 82 to the user input sensor 84 will be disrupted. The user input sensor 84 may be configured to output a signal to the controller 87 based on the pattern of light signals detected. The controller 87, being connected to user input sensor 84 may be configured to generate an operation command for a peripheral device 30 based on the pattern of light signals detected by the user input sensor 84. The controller 87 may be operatively connected to one or more peripheral devices 30 configured to send operational commands to the peripheral devices 30 of the surgical helmet 20 based on the signal received from the user input sensor 84.

Figure 12A:
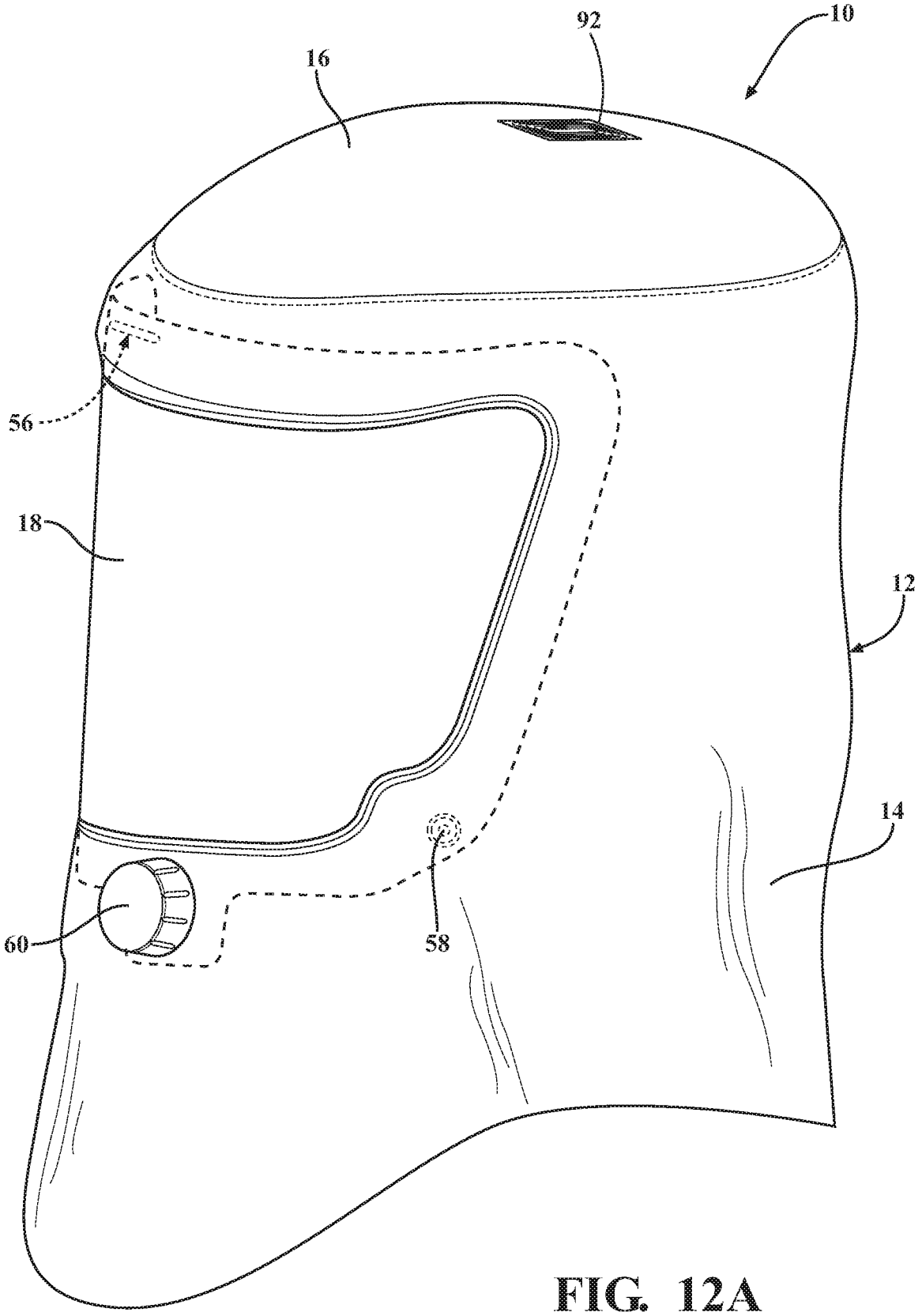
FIG. 12A is a perspective view of a surgical hood with an electromagnetic tag.
Figure 12B:
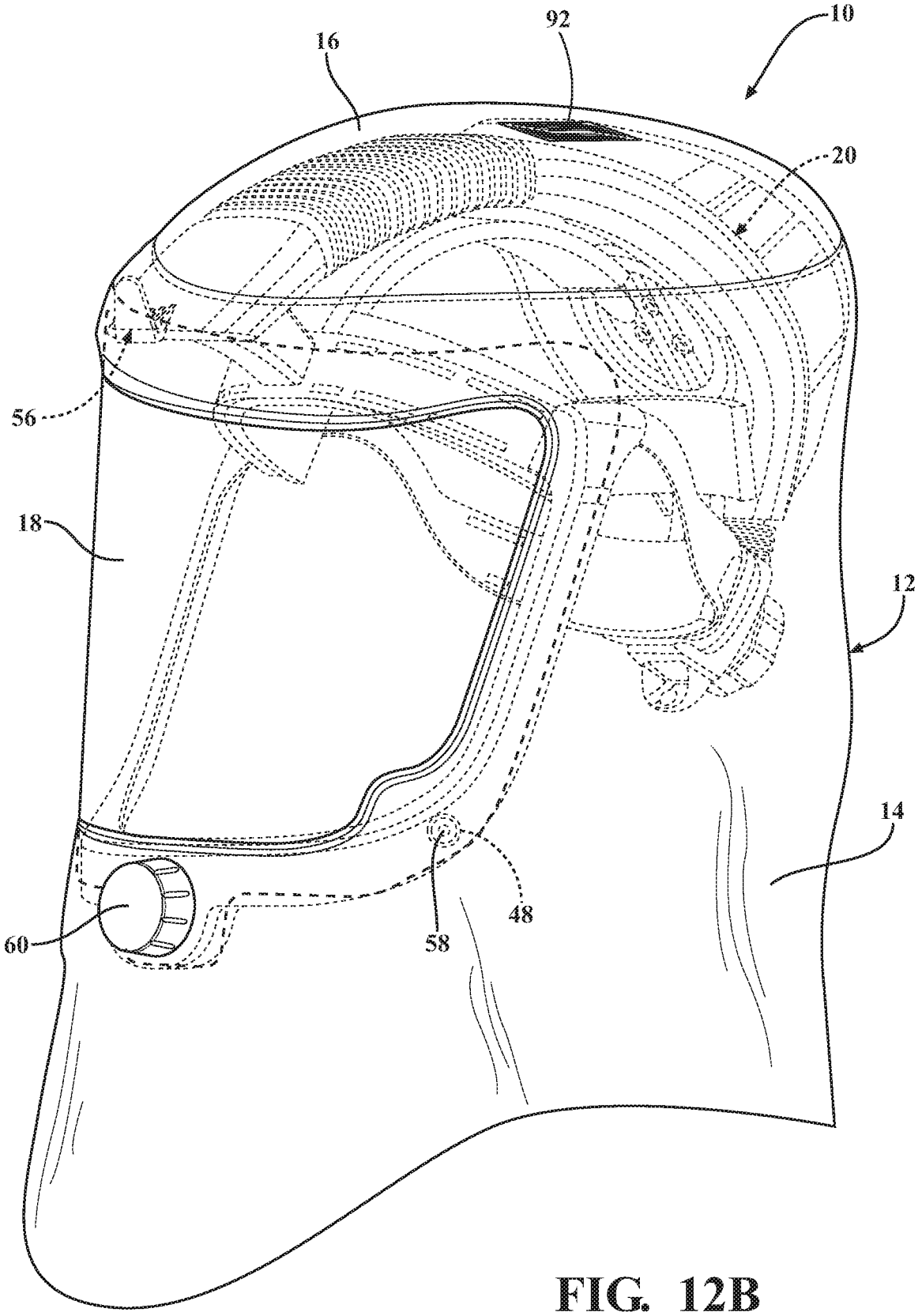
FIG. 12B is a perspective view of a protective apparel system that includes the surgical hood with an electromagnetic tag of FIG. 12A and a surgical helmet, with the surgical helmet shown in phantom.
Figure 12C:
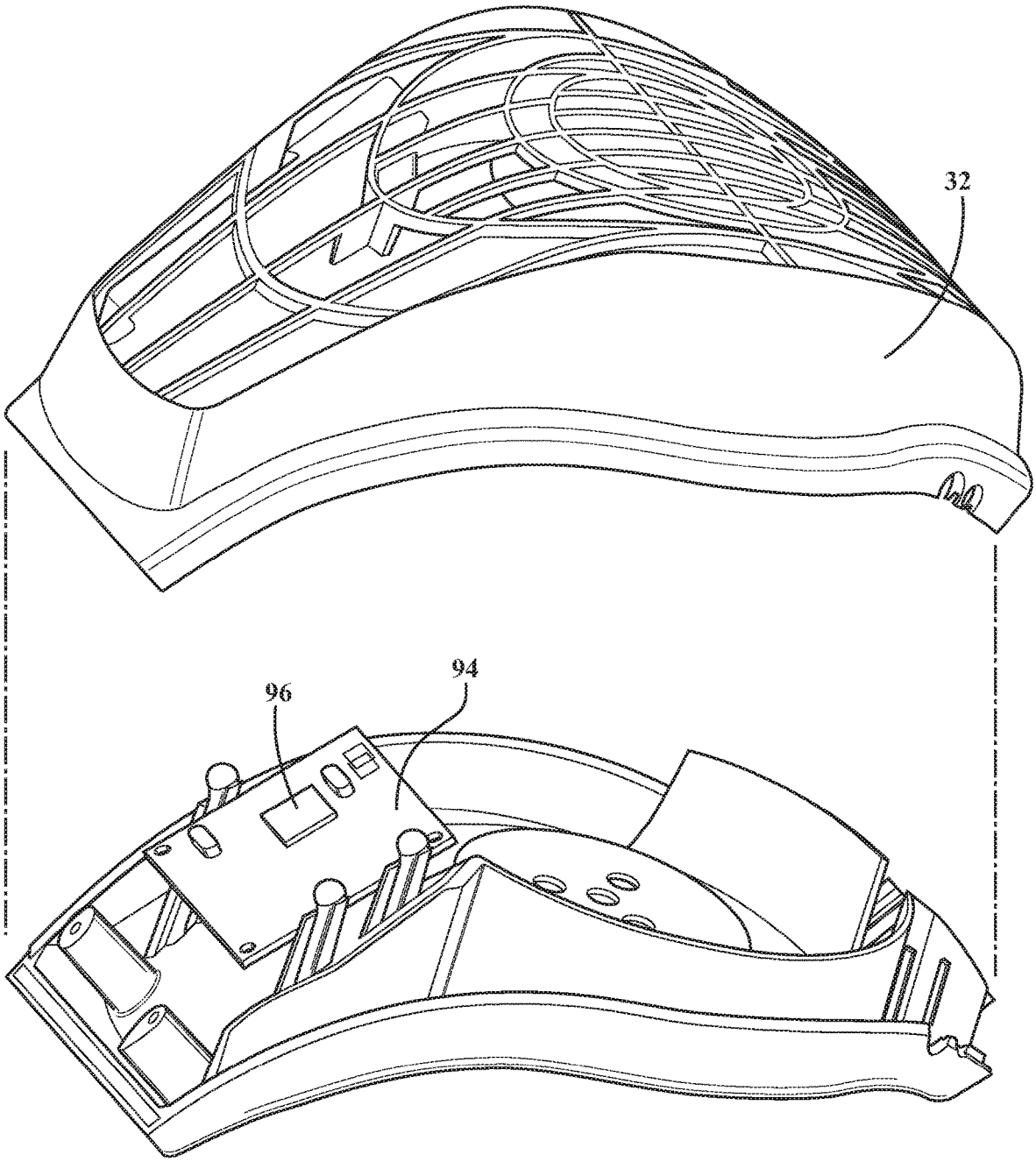
FIG. 12C is an exploded view of the shell of the surgical helmet of the protective apparel system of FIG. 12B.

In each of the above described embodiments, the protective apparel system 10 may be configured to include optional equipment and/or features that prevent operation of the surgical helmet 20 and/or any peripheral devices 30 of the surgical helmet 20 until after the surgical garment 12 has been mounted on the surgical helmet 20. For example, an exemplary embodiment of the system 10 is illustrated in FIGS. 12A-12C, wherein the system 10 may comprise a transceiver 94 that is attached to the surgical helmet 20 and an electromagnetic tag 92 that is attached to the surgical garment 12.

The transceiver 94 may be operably coupled to the surgical helmet 20 and configured to transmit and receive a signal. The transceiver 94 may be positioned anywhere on the surgical helmet 20. For example, the transceiver 94 may be encased in the shell 32 of the surgical helmet 20, as illustrated in FIG. 12C. Alternatively, the transceiver 94 may be encased in the control housing 50 or attached at some other point along the chin bar 24.

The transceiver 94 may be in communication with a memory device 96. The memory device 96 may be operably coupled to the transceiver 94 and configured to store data received in the signal received by transceiver 94. The memory device 96 may be in communication with the controller.

The system may further comprise an electromagnetic tag 92 attached to the surgical garment 12. For example, the electromagnetic tag 92 may comprise an RFID tag, or similar tag configured to contain identification information. The electromagnetic tag 92 may be positioned anywhere on the surgical garment 12. For example, the electromagnetic tag 92 may be attached to the filter fabric 16 of the surgical garment 12. Alternatively, the electromagnetic tag 92 may be attached to the surgical fabric 14 of the surgical garment 12 or may be attached to the control mount of the surgical garment 12. In one embodiment, the tag may be attached to the surgical garment 12 on the wearer side to reduce the likelihood of introducing a non-sterile or contaminated item on the environment side of the barrier defined by the surgical garment 12.

The electromagnetic tag 92 may be configured to transmit or otherwise convey information to the transceiver 94 including information related to the particular surgical garment 12. In one exemplary embodiment, the electromagnetic tag 92 may configured to activate upon receipt of a signal, such as a request for transmission of data, from the transceiver 94. Upon activation of the electromagnetic tag 92, the electromagnetic tag 92 may transmit a signal back to the transceiver 94 comprising data related to the surgical garment 12 associate with the electromagnetic tag 92. In this embodiment, the transceiver 94 may be configured to actively broadcast a signal requesting the transmission of the data. The signal may be broadcast a defined distance from the transceiver 94, and the electromagnetic tag 92 may be configured to transmit a return signal including data related to the surgical garment 12 when the electromagnetic tag 92 is within the defined distance of the transceiver 94. In an exemplary embodiment, the electromagnetic tag 92 may be positioned on the surgical garment 12 such that when the surgical garment 12 is attached to the surgical helmet 20, the electromagnetic tag 92 may be positioned in close proximity of the transceiver 94. This arrangement may allow for the transmission of data from the electromagnetic tag 92 to the transceiver 94 when the surgical garment 12 and surgical helmet 20 are coupled to one another. For example, an exemplary arrangement of the electromagnetic tag 92 and transceiver 94 is illustrated in FIG. 12B, wherein the electromagnetic tag 92 is attached to the filter fabric 16 and the transceiver is encased in the shell 32 of the surgical helmet 20.

As discussed above, the electromagnetic tag 92 may be configured to store data and/or an identifier related to the surgical garment 12, such as a serial number identifying the particular surgical garment 12. The electromagnetic tag 92 may also be configured to store information identifying the type of surgical garment 12 associated with the electromagnetic tag 92. The electromagnetic tag 92 may also store data regarding operational parameters for the peripheral devices 30 of the surgical helmet 20 that are best suited for operation of the peripheral device 30 based on the characteristics of the particular surgical garment 12 attached to the surgical helmet 20, such as the size of the surgical garment, the type of fabric, whether the surgical garment is a hood or a toga, etc.

The transceiver 94 of the helmet 20 may be operably connected to the controller 87, wherein the transceiver 94 is configured to transmit information received from the electromagnetic tag 92 to the controller 87. As discussed above, the information received from the electromagnetic tag 92 may be related to an identifier for the individual surgical garment 12. The controller 87, also being connected to the one or more peripheral devices 30 of the surgical helmet 20, may be configured to output operational command to the peripheral device 30 based, at least in part, on the information received from the transceiver 94 related to the surgical garment 12. For example, the controller 87 may be configured such that only after the surgical garment 12 is mounted to a surgical helmet 20, as confirmed by the transceiver 94 identifying the electromagnetic tag 92 of the surgical garment 12, does the controller 87 generate operational commands that result in the actuation of the peripheral devices 30 of the surgical helmet 20. In other words, the controller 87 may be prevented from generating operational commands for one or more of the peripheral devices 30 until the transceiver 94 sends a signal corresponding to a suitable identifier read on the surgical garment 12. Because the transceiver 94 reads the tag 92 once the surgical garment 12 is placed in proximity to the surgical helmet 20, this eliminates the disadvantages associated with providing a protective apparel system 10 with a ventilation assembly or other peripheral device 30 that is actuated prior to the placement of the surgical garment 12 on the surgical helmet 20. One disadvantage this eliminates is the generation of noise produced by the ventilation assembly 30 when the ventilation assembly 30 is not serving a useful purpose. A second disadvantage that may be eliminated by preventing the actuation of a peripheral device 30 prior to mounting the surgical garment 12 to the surgical helmet 20, is the drawing down of the charge in the power source when actuation of the peripheral device is not needed.

In an exemplary embodiment, a wearable surgical garment 12 for use with a surgical helmet 20 having a peripheral device 30 and a transceiver 94 may be configured to provide a microbial barrier between a medical environment and a wearer. The surgical garment 12 may define an environment side and a wearer side. The surgical garment 12 may further comprise an electromagnetic tag 92 configured to store data related to the surgical garment 12. The electromagnetic tag 92 may be configured to be read with a transceiver 94, which may also be referred to as an electromagnetic reader, of the surgical helmet 20 when electromagnetic tag 92 and said transceiver 94 are within a certain proximity to one another. The stored data on the tag 92 related to the surgical garment 12 may comprise an identifier specific to the surgical garment 12. The operation of the peripheral device 30 of the surgical helmet 20 may be based, at least in part, on the stored identifier. The stored data on the tag 92 related to said surgical garment 12 may further comprise usage data indicating whether the surgical garment 12 has been previously coupled to a surgical helmet 20. The usage data may also indicate how many times the surgical garment 12 has previously been coupled to a surgical helmet 20. The stored data on the tag 92 related to said surgical garment 12 may further comprise authentication data indicating whether the surgical garment 12 is compatible with said surgical helmet 20. This authentication data may include the size of the surgical garment 12, the type of garment, the manufacturer of the garment, and the like. The stored data related to the surgical garment 12 may further comprise operational data including data utilized to generate operational commands for the peripheral device 30 of said surgical helmet 20 based, at least in part, on said operational data. The operational data may include specific operation modes for the peripheral devices 30 of the surgical helmet 20 based on the characteristics of the surgical garment 12. The operational data, may also include minimum and maximum setting information for each peripheral device 30 based on the characteristics of the surgical garment 12. The stored data related to the surgical garment 12 may further comprise an identifier, wherein said identifier is utilized to identify and track the use of the surgical garment 12. For example, the identifier may include a serial number specific to the surgical garment 12, so the usage and location of the surgical garment 12 may be tracked. The controller may prevent operation of the peripheral device if the usage data exceeds a predetermined number of uses, such as a single use.

In another exemplary embodiment, a protective apparel system may comprise a surgical helmet 20 to be worn over the head of a wearer. The surgical helmet 20 may comprise a peripheral device 30 and a transceiver 94. The system may further comprise a surgical garment 12 comprising a surgical fabric 14/16 configured to be at least partially disposed over said surgical helmet 20 to provide a microbial barrier between a medical environment and a wearer. An electromagnetic tag 92 may be coupled to the surgical garment 12, wherein the electromagnetic tag 92 may be configured to store an identifier related to the surgical garment 12. An antenna may be operably coupled to the transceiver 94 and configured to communicate with the electromagnetic tag 92 to receive the identifier related to the surgical garment 12. The protective apparel system may further comprise a controller 87 operably coupled to the peripheral device 30 and to the transceiver 94. The controller 87 may be configured to communicate operational commands to the peripheral device 30 based, at least in part, on the identifier related to the surgical garment 12. The electromagnetic tag 92 may be configured to store and transmit usage data for the surgical garment 12, and the controller 87 may be configured to determine if the surgical garment 12 has been previously worn with the surgical helmet 20. The controller 87 may be configured to prevent actuation of the peripheral device 30 if the surgical garment 12 has been previously worn based, at least in part, on the stored usage data. The electromagnetic tag 92 may also be configured to store authentication data for the surgical garment 12, and the controller 87 may be configured to determine if the surgical garment 12 is compatible with the surgical helmet 20. The controller 87 may be configured to prevent actuation of the peripheral device 30 if the surgical garment 12 is not compatible with the surgical helmet 20 based, at least in part, on the stored authentication data. When the identifier is related to the type of surgical garment 12, the controller 87 may be configured to determine an operating mode of (generate an operational command for) the peripheral device 30 based, at least in part, on the type of surgical garment 12 attached to the surgical helmet 20. For example, the controller 87 may be configured to increase or decrease power output to the peripheral device 30 based, at least in part, on the type of surgical garment 12 attached to the surgical helmet 20. In an exemplary embodiment wherein the peripheral device 30 is a ventilation assembly, the controller 87 may be configured to increase the power output to said ventilation assembly when the type of surgical garment 12 comprises a thicker fabric and/or is a larger size (suggesting a larger volume of space under the surgical garment 12).

The memory device 96 of the transceiver 94 may be configured to store the data received from the electromagnetic tag 92 of the surgical garment 12. The information stored on the memory device 96 may be utilized to identify when a previously worn surgical garment 12 has been reattached to the surgical helmet 20. For example, a surgical garment 12 may be attached to the surgical helmet 20 by the wearer. The memory device 96 may be configured to store the data, such as a serial number, identifier, model number, garment characteristics, or similar information, received from the electromagnetic tag 92 of the surgical garment 12 for later use. The data stored in the memory device 96 may be utilized to prevent operation of the peripheral device 30 in the event a previously worn surgical garment 12 is reattached to the surgical helmet 20 at a later point in time. For example, in operation, when the surgical garment 12 is attached to the surgical helmet 20, and the transceiver 94 receives data from the electromagnetic tag 92 of the surgical garment 12, the memory device 96 will store the data. The data may include a serial number or other identifying characteristic. If a wearer were to attempt to re-attach the same surgical garment 12 to the surgical helmet 20, when the transceiver 94 receives the data from the electromagnetic tag 92, the memory device 96 would already contain the same data. When the transceiver 94 transfers the data from the memory device to the controller, the controller 87 may configured to recognize the second entry of data for the surgical garment 12. Upon recognizing the second entry for the surgical garment 12, the controller 87 may be configured to prevent operation of the peripheral device 30 until a new surgical garment is attached to the surgical helmet 20.

It is possible for the power source to for the system 10 to run out during a medical procedure, which could result in a false positive identification of a re-used surgical garment when the system is restarted. For example, if the battery for the system 10 were to run out in the middle of the procedure, when a new battery is attached and a new signal is transmitted from the electromagnetic tag 92 to the transceiver 94, the memory 96 is likely to show that the attached surgical garment 12 was previously attached to the surgical helmet 20. As described above, in this scenario the controller 87 would be configured to prevent the peripheral device 30 from operating. In order to prevent operation of the peripheral device based on a false positive identification of the surgical garment 12, the system 10 may further comprise a capacitor operably coupled to the controller 87 and configured to store energy. The controller 87 may be configured to identify that if the capacitor is storing energy, the power source for the system 10 was recently removed. Based on the identification that the power source was recently removed, the controller 87 may be configured to allow for operation of the peripheral device 30 even though the data from the memory device 96 suggests the surgical garment was previously worn. The controller 87 may also be configured to allow for operation of the peripheral device 30 even though the data from the memory device 96 suggests the surgical garment was previously worn based on the amount of time between the first instances when the surgical garment 12 was identified as being attached to the surgical helmet 20, and the second instance when the surgical garment 12 was identified as being attached to the surgical helmet 20. For example, if the controller 87 were to identify that the time between the first instance in which the surgical garment 12 was attached and the second instance the surgical garment 12 was attached was less than then two hours, the controller 87 may be configured to allow for operation of the peripheral device 30. However, the amount of time may configured as would be reasonably appropriate in the given industry based on the use of the surgical garment 12.

Other versions of the system 10 may have different sub-assemblies for ensuring that only when the surgical garment 12 is fitted to the surgical helmet 20, the peripheral devices 30, such as the ventilation assembly, actuated. For example, it should be understood that the control mount 70 and/or control housing 50 may include a garment detector (such as the reader described herein) operably coupled to the controller 87 and configured to detect the attachment of the surgical garment 12 to the surgical helmet 20. The garment detector may comprise a pressure sensor, a load sensor, or similar type of sensor configured to detect the attachment of the surgical garment 12 to the surgical helmet 20. For example, the wearer side coupler 76 of the control mount 70 and/or the coupling device 78 of the control housing 50 may comprise the garment detector in the form of a pressure sensor configured to detect the attachment of the surgical garment 12 to the surgical helmet 20. In an exemplary embodiment of the system 10, the system 10 may configured so that the controller 87 may activate the peripheral device 30 when a power source is attached to the surgical helmet 20 to complete a status check for a predetermined amount of time, e.g., 30 s, and confirm the peripheral device 30 is functioning properly. Once the controller 87 has competed the status check, the controller 87 may be configured to prevent any further actuation of the peripheral device 30 until the controller 87 receives a signal from the garment detector indicating that the surgical garment 12 has been attached to the surgical helmet 20. Upon the controller 87 receiving a signal from the garment detector indicating the surgical garment 12 has been attached to the surgical helmet 20, the controller may be configured to generate an operational command for the power source to energize the peripheral device.

For example, in operation, the wearer may place the surgical helmet 20 including a ventilation assembly 30 on their head and attach a battery power source to the surgical helmet 20. The controller 87 may then actuate the ventilation assembly 30 to confirm the ventilation assembly is working properly. The controller 87 may then deactivate the ventilation assembly 30. Next, the wearer may attach the surgical garment 12 to the surgical helmet 20. The attachment of the surgical garment 12 to the surgical helmet may be detected by a pressure sensor, switch, transceiver 94 configured to detect presence of an RFID tag 92 on the surgical garment 12, or similar device. The detector may then send a signal to the controller to confirm the surgical garment has been attached to the surgical helmet 20. The controller 87 may then actuate the ventilation assembly 30.

In yet another embodiment of the system 10, the surgical garment 12 and surgical helmet 20 may each comprise complementary conductors. When the surgical garment 12 is fitted to the surgical helmet 20, a conductor integral with the surgical garment 12 closes the connection between the surgical garment 12 and the surgical helmet 20. For example, the conductor of the surgical garment 12 may be integrally formed with the face shield 18 and the complementary conductor may be included in the control housing such that the circuit becomes closed once the conductor of the face shield 18 engages the conductor in the control housing. The conductors may further be in communication with the magnets/ferrous elements of the surgical garment 12 or the control housing 50. A detector may be configured to sense the closing of the circuit between the magnets of the face shield 18 and surgical garment 12. In response to detecting this change in circuit state, the detector may generate a signal to the controller 87 indicating that the circuit is in the closed state and ready for actuation. In certain embodiments, the controller 87 can only generate operational command signals that result in the actuation of the peripheral devices 30 when this signal is received by the controller 87.

It should be appreciated that in some embodiments of the system 10, the removal of the surgical garment 12 from the surgical helmet 20 may result in the reopening of the circuit between the magnets 76, 78 of the surgical garment 12 and the surgical helmet 20, respectively. The detector, in response to the detection of the reopening of this circuit may generate a signal indicating that the system 10 is in the open state to the controller 87. The controller 87, in response to receiving the signal from the detector, may be configured to return the peripheral devices 30 of the surgical helmet 20 to the off state. Thus, a further feature of these embodiments of the system 10 is that, when the surgical garment 12 is removed from the surgical helmet 20 and use of the ventilation assembly 30 is no longer required, the ventilation assembly 30 or other peripheral device is automatically shut off. Similar modes of operation are also contemplated with the other detector assemblies described above.

Another device for detecting the absence/presence of the surgical garment 12 may include the use of fasteners on the surgical helmet 20 that are conductive and attracted to magnetic fields. Adjacent to the fastener may be a sensor. The sensor may be configured to output a signal related changes based on the absence or presence of a magnetic field created by attaching and/or removing the surgical garment 12 from the surgical helmet 20. The sensor may be a Hall-effect sensor. In some versions of the system 10, sensor may be a switch. The open/closed state of this switch is understood to be a function of the absence or presence of a magnetic field, which is related to the surgical garment 12 being attached or removed from the surgical helmet 20.

Alternatively, the system 10 may be configured to include a switch that may be displaced when the surgical garment 12 is attached or removed from the surgical helmet 20. In this embodiment, a sensor may be configured to generate a signal indicating whether or not the surgical garment 12 is fitted to the surgical helmet 20 based on a switch that is physically displaced upon the fitting of the surgical garment 12 to or removal of the surgical garment 12 from the surgical helmet 20. In this embodiment of the system 10, the sensor may be a switch with a spring loaded pin. The switch is fitted to the surgical helmet 20 to be at a location at which, when the surgical garment 12 is mounted to the face shield 18, a portion of the surgical garment 12 will displace the pin. Typically, the switch is mounted to the surgical helmet 20 so, when the surgical garment 12 is fitted over the surgical helmet 20, either the face shield 18 or a component attached to the face shield 18 abuts and displaces the pin. This displacement of the pin causes the state of the switch to change. The controller 87 may be operably connected to the switch. Accordingly, the controller 87 may be configured to recognize that the state of the switch serves as an indication as to whether or not the surgical garment 12 is attached to the surgical helmet 20. Based on the state of the switch, the controller 87 may be configured to generate operational commands related to the actuation of the peripheral devices 30. For example, when the pin of the switch is depressed, the controller 87 may configured to recognize that the surgical garment 12 is attached to the surgical helmet 20 and allow for actuation of the peripheral devices 30. Alternatively, when the pin of the switch is not depressed, the controller 87 may be configured to recognize that the surgical garment 12 is not attached to the surgical helmet 20 and prevent the actuation of the peripheral devices 30. It should thus be appreciated that, in the above-described embodiment of the system, the portion of the surgical garment 12 that depresses the switch of the sensor functions as the indicator that the surgical garment 12 is attached to the surgical helmet 20.

In some versions of the protective apparel system 10, based on whether or not the surgical garment 12 is detected/fitted to the surgical helmet 20 the controller may regulate whether or not other peripheral devices 30 are actuated. Thus, the controller may inhibit the actuation of one or more of the light assembly, the communications unit or the cooling strip based on whether or not an appropriate surgical garment 12 is fitted to the surgical helmet 20.

The above are directed to specific embodiments of the system 10. It should be understood that the individual features of the different embodiments of the system 10 may be combined to construct alternative embodiments of the system 10.

Clauses for Alternative Protection

I. A surgical garment assembly for use with a surgical helmet having a peripheral device, said surgical garment assembly comprising:

a wearable surgical garment configured to provide a microbial barrier between a medical environment and a wearer, said surgical garment defining an environment side and a wearer side, said surgical garment comprising a surgical fabric; and a control member coupled to said surgical garment on said environment side, said control being manipulatable by the wearer to control operation of the peripheral device through manipulation of said control member.

Ia. The surgical garment of clause I, wherein said surgical fabric comprises a pleat adjacent said control member to allow said surgical fabric to deform during manipulation of said control member.

II. A surgical garment assembly for use with a surgical helmet having a peripheral device, said surgical garment assembly comprising:

a wearable surgical garment configured to provide a microbial barrier between a medical environment and a wearer, said surgical garment defining an environment side and a wearer side, said surgical garment comprising a surgical fabric, and a control mount integral with said surgical garment such that said control mount forms at least a portion of said microbial barrier, wherein said control mount is configured to couple to the surgical helmet on said wearer side and said control mount is configured to couple to a control member on said environment side such that the control member can move relative to said surgical mount.

III. A surgical garment assembly for use with a surgical helmet having a peripheral device, said surgical garment assembly comprising:

a surgical garment configured to provide a microbial barrier between a medical environment and a wearer, said surgical garment defining an environment side and a wearer side, said surgical garment comprising a surgical fabric and a face shield;

a control mount integral with said surgical garment such that said control mounts forms at least a portion of said microbial barrier, wherein said control mount is configured to couple to the surgical helmet on said wearer side; and a control member coupled to said control mount on said environment side, said control being manipulatable by the wearer to control operation of the peripheral device through manipulation of said control member.

IIIa. The wearable surgical garment of clause III, wherein said control mount comprises a lens portion configured to transmit light through said microbial barrier.

IIIb. The wearable surgical garment of clause III or IIIa, wherein said control member comprises a knob.

IIIc. The wearable surgical garment of clause III or IIIa or IIIb, wherein said control member comprises an encoder element.

IIId. The wearable surgical garment of clause III or IIIa or IIIb or IIIc, wherein said surgical garment is a surgical toga or a surgical hood.

IIIe. A protective apparel system comprising:

the wearable surgical garment of clauses III, IIIa, IIIb, IIIc, or IIId, a surgical helmet to be worn over the head of a wearer, said surgical helmet comprising a user input sensor, and a peripheral device.

IIIf. The protective apparel system of clause IIIe, wherein said peripheral device comprises a ventilation assembly.

IIIg. The protective apparel system of clause IIIe or IIIf, wherein said user input sensor comprises a photodetector or a hall-effect sensor IIIh. The protective apparel system of clause IIIe, IIIi or IIIg, wherein said surgical helmet further comprises an emitter, wherein the emitter comprises a light source.

IIIi. The protective apparel system of clause IIIe, IIIf, or IIIg, wherein said encoder element comprises one or more magnets configured to be detected by the hall-effect sensor.

IV. A protective apparel system comprising:

a surgical helmet to be worn over the head of a wearer, said surgical helmet comprising a peripheral device and a controller in communication with said peripheral device; and optionally, a wearable surgical garment configured to be at least partially disposed over said surgical helmet to provide a microbial barrier between a medical environment and a wearer, said surgical garment having a wearer side and an environment side, and said surgical garment comprising a surgical fabric, wherein said controller configured to detect a proximity of said surgical garment, and said controller is configured to control said peripheral device based on said proximity of said surgical garment.

IVa. The protective apparel system of clause IV, wherein said peripheral device comprises a ventilation assembly.

IVb. The protective apparel system of clause IV or IVa, wherein said surgical garment comprises an electromagnetic tag, and said surgical helmet comprises a transceiver, wherein said controller is configured to detect proximity of said surgical garment to said surgical helmet based on whether said transceiver receives a signal from said electromagnetic tag.

IVc. The protective apparel system of clause IV or IVa, wherein one of said surgical garment and said surgical helmet comprises a switch that is configured to be activated when the surgical garment is coupled to said surgical helmet, wherein said controller is configured to detect proximity of said surgical garment to said surgical helmet based on a state of said switch.

IVd. The protective apparel system of clause IV or IVa, wherein said surgical garment comprises a first conductor and said helmet comprises a second conductor, wherein said controller is configured to detect proximity of said surgical garment to said surgical helmet based on whether a circuit is formed based on said first conductor being in communication with said second conductor.

IVe. The protective apparel system of clause IV-IVd, wherein said controller configured to turn off said peripheral device if said controller determines that said surgical garment is not in proximity to said surgical helmet.

IVf. The protective apparel system of clause IV-IVe, wherein said controller configured to turn off said peripheral device if said controller determines that said surgical garment is not in proximity to said surgical helmet after a predetermined period of time, wherein said predetermined period of time corresponds to a functional test mode.

IVg. The protective apparel system of clause IV-IVf, wherein said controller is configured to determine when a new battery is coupled to said controller, and wherein said controller is authenticates said surgical garment, even if prior use is detected, if said controller determines that said surgical garment is in proximity to said surgical helmet when said controller determines that the new battery has been coupled to said controller.

V. A protective apparel system comprising:

a surgical helmet to be worn over the head of a wearer, said surgical helmet comprising a peripheral device, a controller, a transceiver, and a memory unit;

a surgical garment comprising a surgical fabric configured to be at least partially disposed over said surgical helmet to provide a microbial barrier between a medical environment and a wearer;

an electromagnetic tag coupled to the surgical garment, said electromagnetic tag configured to store an identifier related to said garment; and an antenna operably coupled to said transceiver and configured to communicate (interact) with said electromagnetic tag to receive said identifier related to said garment.

Va. The protective apparel system of clause V, wherein said controller is configured to detect whether a battery has been removed from the surgical helmet within a predetermined period of time, optionally, based on whether a capacitor in electrical communication with said battery includes an amount of energy that exceeds a threshold amount.

Vb. The protective apparel system of clause V or Va, wherein said controller is configured to authenticate based on whether the identifier of the tag has been previously stored in said memory unit and whether the battery has been removed from the surgical helmet within a predetermined period of time.

Also, while the protective apparel system 10 is generally intended to provide a barrier between the medical practitioner and the patient during a medical or surgical procedure, its use is not so limited. It is within the scope of this disclosure that the protective apparel system 10 may be used in other endeavors in which it is desirable to provide a barrier between an individual and the surrounding environment. One alternative endeavor in which it may be so desirable to use the system 10 is one in which it is desirable to provide a barrier between the individual and hazardous material in the environment in which the individual is working.

Several embodiments have been discussed in the foregoing description. However, the embodiments discussed herein are not intended to be exhaustive or limit the system 10 to any particular form. The terminology which has been used is intended to be in the nature of words of description rather than of limitation. Many modifications and variations are possible in light of the above teachings and the system may be practiced otherwise than as specifically described.

What is claimed is:

1. A protective apparel system comprising:

a surgical helmet to be worn over a head of a wearer, said surgical helmet comprising a light source and a photodetector, and a ventilation assembly;

a surgical garment configured to be at least partially disposed over said surgical helmet to provide a microbial barrier between a medical environment and a wearer, said surgical garment having a wearer side and an environment side, and said surgical garment comprising a surgical fabric;

a control mount integral with said surgical garment such that said control mount forms at least a portion of said microbial barrier and wherein said control mount is configured to transmit light through said microbial barrier; and a control member movably coupled to said control mount on said environment side, said control member being manipulatable by the wearer to control operation of said ventilation assembly through manipulation of said control member, said control member is configured to move relative to said control mount and relative to said photodetector such that said photodetector is capable of determining position of said control member based on manipulation of said control member by the wearer.

2. The protective apparel system of claim 1, wherein said control mount is configured to couple to said surgical helmet on said wearer side.

3. The protective apparel system of claim 1, wherein said control member further comprises an encoder element.

4. The protective apparel system of claim 3, wherein said control mount comprises a lens portion configured to transmit light from said light source through said microbial barrier; and wherein said encoder element is configured to alter transmission of light from said light source of said surgical helmet to said photodetector of said surgical helmet based on a position of said control member relative to said lens portion of said control mount.

5. The protective apparel system of claim 4, wherein said lens portion comprises a first lens portion and a second lens portion, said first lens portion configured to align with said light source of said surgical helmet to allow transmission of light from said light source through said first lens portion, and said second lens portion configured to align with said photodetector of said surgical helmet to allow transmission of light through said second lens portion to said photodetector.

6. The protective apparel system of claim 4, wherein said control member comprising an encoder element configured to alter the transmission of light from said light source of said surgical helmet to said photodetector of said surgical helmet based on a position of said control member.

7. The protective apparel system of claim 1, wherein said control mount comprises an alignment feature configured to align said control mount of said surgical garment with said photodetector of said surgical helmet.

8. The protective apparel system of claim 1, wherein said surgical helmet comprises a chin bar, and said photodetector is coupled to said chin bar.

9. The protective apparel system of claim 1, wherein said light source is arranged to emit light through said control mount that is detectable by said photodetector when said control mount is coupled to said surgical helmet.

10. The protective apparel system of claim 1, wherein said surgical helmet comprises a controller in communication with said photodetector, said controller configured to control an operational characteristic of said ventilation assembly based on a signal from a user input sensor.

11. A protective apparel system comprising:

a surgical helmet to be worn over a head of a wearer, said surgical helmet comprising:

a peripheral device;

a chin bar;

an emitter at least partially disposed in said chin bar; and a user input sensor at least partially disposed in said chin bar;

a surgical garment configured to be at least partially disposed over said surgical helmet to provide a microbial barrier between a medical environment and a wearer, said surgical garment having a wearer side and an environment side, and said surgical garment comprising a surgical fabric;

a control mount integral with said surgical garment such that said control mount forms at least a portion of said microbial barrier, said control mount comprises a lens portion configured to transmit light from said emitter through said microbial barrier and is configured to couple to said chin bar of said surgical helmet on said wearer side; and a control member movably coupled to said control mount on said environment side, said control member being manipulatable by the wearer to control operation of said peripheral device through manipulation of said control member;

wherein said control member is configured to alter transmission of light from said emitter of said surgical helmet to said user input sensor based on a position of said control member relative to said lens portion of said control mount.

12. The protective apparel system of claim 11, wherein said control member is configured to move relative to said user input sensor such that said user input sensor is capable of determining manipulation of said control member by the wearer to control operation of said peripheral device.

13. A protective apparel system comprising:

a surgical helmet to be worn over a head of a wearer, said surgical helmet comprising:

a peripheral device;

a user input sensor; and an emitter capable of producing a signal that is detectable by said user input sensor;

a wearable surgical garment removably coupled to said surgical helmet and configured to provide a microbial barrier between a medical environment and a wearer, said surgical garment defining an environment side and a wearer side, said surgical garment comprising a surgical fabric;

a control mount integral with said surgical garment such that said control mounts forms at least a portion of said microbial barrier, said control mount comprising:

a first coupler and a second coupler, said first coupler is at least partially disposed on said environment side of said surgical garment and said second coupler is at least partially disposed on said wearer side of said surgical garment; and a lens portion configured to transmit light through said microbial barrier, said lens portion comprises a first lens portion and a second lens portion;

wherein said first lens portion is configured to align with said emitter of said surgical helmet to allow transmission of light from said emitter through said first lens portion; and wherein said second lens portion is configured to align with said user input sensor of said surgical helmet to allow transmission of light through said second lens portion to said user input sensor;

a control member coupled to said control mount by said first coupler on said environment side of said surgical garment, said control member being manipulatable by the wearer to control operation of said peripheral device through manipulation of said control member; and wherein said second coupler is configured to removably engage said surgical helmet to couple said surgical garment to said surgical helmet on said wearer side.

14. The protective apparel system of claim 13, wherein said surgical helmet further comprises a chin bar;

wherein said user input sensor is at least partially disposed in said chin bar and said emitter is at least partially disposed in said chin bar.

15. The protective apparel system of claim 14, wherein said control mount defines a protrusion on the wearer side of said microbial barrier that projects proximally;

wherein said second coupler is disposed on said protrusion; and wherein said chin bar further comprises a recess configured to receive a portion of said protrusion and a coupling device configured to engage said second coupler to removably couple said surgical garment to said surgical helmet.

16. The protective apparel system of claim 14, wherein said control mount defines a recess on the wearer side of said microbial barrier; and wherein said chin bar further comprises a complementary shaped protrusion configured to be at least partially disposed in said recess when said surgical garment is coupled to said surgical helmet.

17. The protective apparel system of claim 13, further comprising a controller in communication with said user input sensor;

wherein said user input sensor is configured to provide a sensor input signal to said controller based on the manipulation of said control member; and wherein said controller is configured to control an operational characteristic of said peripheral device based on said sensor input signal.

* * * * *